US009132525B2

(12) United States Patent
Shinozaki

(10) Patent No.: US 9,132,525 B2
(45) Date of Patent: Sep. 15, 2015

(54) POLISHING APPARATUS FOR FLATTENING SURFACE OF WORKPIECE

(71) Applicant: EBARA CORPORATION, Tokyo (JP)

(72) Inventor: Hiroyuki Shinozaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 12 days.

(21) Appl. No.: 14/040,449

(22) Filed: Sep. 27, 2013

(65) Prior Publication Data

US 2014/0094098 A1 Apr. 3, 2014

(30) Foreign Application Priority Data

Sep. 28, 2012 (JP) ..... 2012-215589
Sep. 28, 2012 (JP) ..... 2012-215592

(51) Int. Cl.
*B24B 49/16* (2006.01)
*B24B 37/013* (2012.01)
*B24B 49/10* (2006.01)

(52) U.S. Cl.
CPC ..... *B24B 49/16* (2013.01); *B24B 37/013* (2013.01); *B24B 49/10* (2013.01)

(58) Field of Classification Search
CPC .... B24B 37/005; B24B 37/013; B24B 49/10; B24B 49/16
USPC ..... 340/680; 451/5, 8, 9, 287, 288, 290
See application file for complete search history.

(56) References Cited

U.S. PATENT DOCUMENTS

| | | | | |
|---|---|---|---|---|
| 6,416,615 | B1 * | 7/2002 | Lai et al. | 156/345.13 |
| 6,494,765 | B2 * | 12/2002 | Gitis et al. | 451/5 |
| 6,547,637 | B1 * | 4/2003 | Zhang | 451/5 |
| 7,189,139 | B2 * | 3/2007 | Ono | 451/5 |
| 7,878,882 | B2 * | 2/2011 | Molnar | 451/5 |
| 2003/0077986 | A1 * | 4/2003 | Schultz et al. | 451/41 |

FOREIGN PATENT DOCUMENTS

| | | |
|---|---|---|
| JP | 10-202523 | 8/1998 |

* cited by examiner

*Primary Examiner* — Timothy V Eley
(74) *Attorney, Agent, or Firm* — Baker & Hostetler LLP

(57) ABSTRACT

To provide a polishing apparatus capable of more accurately determining a polishing end point. The polishing apparatus includes a turntable 12, a first electric motor 14 configured to rotationally drive the turntable, a top ring 20 configured to hold a workpiece together with the turntable, and a second electric motor 22 configured to rotationally drive the top ring. The polishing apparatus further includes a weighting unit configured to perform weighting so as to make the current ratios of the respective phases different from each other, and a torque variation detecting unit configured to detect a change in a phase current greatly weighted by the weighting unit and thereby detects a change in torque of the electric motor, the change being generated by performing the polishing.

21 Claims, 16 Drawing Sheets

POLISHING APPARATUS FOR FLATTENING SURFACE OF WORKPIECE

CROSS REFERENCE TO RELATED APPLICATION

This application claims priority to Japanese Patent Application No. 2012-215589, filed Sep. 28, 2012 and Japanese Patent Application No. 2012-215592, filed Sep. 28, 2012, the entire contents of which are hereby incorporated by reference.

TECHNICAL FIELD

The present invention relates to a polishing apparatus, and more particularly to a polishing apparatus for polishing and flattening the surface of a workpiece (an object to be polished) such as a semiconductor wafer.

BACKGROUND ART

In recent years, following the high integration of semiconductor devices, wirings of circuits have been miniaturized, and the distance between the wirings has also been reduced. Especially, in the case of optical lithography for making micro-lithographic patterns having dimensions of 0.5 μm or less, the depth of focus becomes shallow, and hence the flatness of the image forming surface of the stepper is required. Therefore, it is necessary to flatten the surface of a semiconductor wafer, and as one of the flattening methods, a method is adopted in which the surface of a semiconductor wafer is polished by using a polishing apparatus.

Conventionally, a polishing apparatus of this kind includes a top ring and a turntable having a polishing cloth stuck to the upper surface thereof, and each of the top ring and the turntable is independently rotated at a rotational speed. Further, while a liquid (slurry) containing abrasive powder is poured onto the polishing pad stuck to the turntable, a semiconductor wafer, as a workpiece, which is set at the top ring, is pressed against the polishing pad, so that the surface of the semiconductor wafer is polished to a flat mirror surface.

The polishing speed of this kind of the polishing apparatus is varied by being influenced by variations in the surface state of the semiconductor wafer which have occurred in the previous process, and by the abrasion state of the polishing pad, and subtle changes of the slurry. If the semiconductor wafer is insufficiently polished, there arises a possibility that circuits are not insulated from each other and thereby short circuited with each other. Further, when the semiconductor wafer is excessively polished, the cross-sectional area of the wiring is reduced to cause such problems that the resistance value of the wiring is increased, and that the wiring itself is completely removed and thereby the circuit itself is not formed. For this reason, the polishing apparatus of this kind is provided with a polishing end point detection apparatus to detect an optimum polishing end point.

As a polishing end point detecting method of the polishing apparatus described above, there is known a method of detecting a change in the polishing friction force at the time when a different material begins to be polished with progress of the polishing (Japanese Patent Laid-Open No. 10-202523). A semiconductor wafer which is to be polished has a laminated structure formed of different materials including a semiconductor, a conductor, and an insulator, each of which has a different friction coefficient. Therefore, the method is configured to detect a change in polishing friction force at the time when a different material begins to be polished with progress of the polishing. In this method, the polishing process is ended at the time when a different material begins to be polished. Further, by detecting a change in polishing friction force at the time when the surface of a semiconductor wafer is changed from an uneven state to a flattened state, the polishing apparatus can also detect that the surface of the semiconductor wafer is flattened.

Here, a change in polishing friction force is detected as follows. Since polishing friction force acts on a position deviated from the rotation center of the turntable, the polishing friction force acts as load torque on the rotating turntable. For this reason, the polishing friction force can be detected as torque acting on the turntable. When means for rotationally driving the turntable is an electric motor, the load torque can be measured as a current flowing into the motor. For this reason, the polishing end point is detected in such a manner that the motor current is monitored with an ammeter and that the measured result is subjected to a suitable signal processing.

FIG. 10 shows a configuration example of a method for detecting a polishing end point on the basis of a change in the current inputted into a drive motor. An electric motor 500 is driven by an AC commercial power supply 512 via an inverter apparatus 510. In the inverter apparatus 510, power from the AC commercial power supply 512 is converted into DC power by a convertor unit 514, so as to be accumulated in a condenser 516. The DC power is inversely converted into AC power of an arbitrary frequency and an arbitrary voltage by an inverter unit 518, and the converted AC power is supplied to the electric motor 500 via a three-phase cables 520. The three-phase cables of the inverter apparatus 510, which supply the AC power to the electric motor 500, are respectively connected to three-phase field windings of the electric motor 500. A current convertor (CT) 522 is provided at the cable of one phase, for example, the cable of the V-phase, of the three-phase cables 520 which supply the AC power to the electric motor 500 to detect the motor current. As the value of the motor current flowing through the current supply line connected to the electric motor 500, the value of current flowing through the V-phase is detected by an ammeter 524 and is sent to end point detection means of a control circuit of a polishing apparatus (not shown), so that the polishing end point is determined on the basis of a change in the value of the detected current.

In recent years, as semiconductor devices have become more highly integrated, wirings of circuits have been becoming more miniaturized, and the distance between the wirings have also been reduced more than before. Therefore, it is desired to further improve the flatness of a semiconductor wafer. However, the above-described method, in which the value of current flowing through one phase is detected by an ammeter, and in which the polishing end point is determined on the basis of a change in the detected current value, is not sufficient in order to improve the flatness of a semiconductor wafer more than before.

Further, in the conventional technique described above, the polishing end point is detected in such a manner that the current of one phase (for example, V-phase) of the three phases of the electric motor is measured, and that a change in the torque of the electric motor is detected on the basis of a change in the detected current. In practice, however, each phase current of the electric motor can be varied. In addition, the current of each phase of the electric motor is not changed in a manner that the current value of a specific phase is always increased or decreased, but there is a possibility that the current of the electric motor is variously changed due to variations between the electric motors and due to variations between the polishing apparatuses.

In this situation, when the polishing end is detected by measuring current of specific one phase of the electric motor, the detected current is variously changed, which results in a possibility that, when a change in the torque of the electric motor is detected, the detected value is also variously changed.

SUMMARY OF INVENTION

The present invention has been made in view of the above-described problem. An object of the present invention is to provide a polishing apparatus for flattening a surface of a workpiece, the polishing apparatus being featured by including a polishing table, a first electric motor configured to rotationally drive the polishing table, a substrate holding unit configured to hold the workpiece, a second electric motor configured to rotationally drive the substrate holding unit, at least one of the first and second electric motors having a plurality of phase windings, a weighting unit configured to perform weighting to make current ratios of the respective phases different from each other, and a torque variation detecting unit configured to detect a change in the phase current greatly weighted by the weighting unit and thereby detect a change in torque of the electric motor, the change being generated by performing the polishing.

The polishing apparatus may further include an end point detecting unit configured to detect an end point of a polishing process for flattening the surface of the workpiece, on the basis of a change in the torque of the electric motor, the change being detected by the torque variation detecting unit.

In the polishing apparatus, at least one of the first and second electric motors may be provided with at least three phase windings of a U-phase, a V-phase, and a W-phase.

In the polishing apparatus, the first electric motor may be provided with at least the three phase windings of the U-phases, the V-phase, and the W-phase.

In the polishing apparatus, the first electric motor may be configured by a synchronous-type AC servo motor or an induction-type AC servo motor.

In the polishing apparatus, the weighting unit may assign a large weighting value to one phase.

In the polishing apparatus, the one phase may be the V-phase.

In the polishing apparatus, the weighting unit may be configured by a current amplifier.

The polishing apparatus can include a first inverter apparatus configured to control the first electric motor.

In the polishing apparatus, the weighting unit can include a second inverter apparatus configured to connect in parallel with the first inverter apparatus, and control the first electric motor, and a switching circuit configured to add a current outputted from the second inverter apparatus to an output current of the first inverter apparatus.

The polishing apparatus further includes a motor driver configured to drive at least one of the first and second electric motors, and can also be configured such that the motor driver includes a current compensator configured to compensate each of the phase currents on the basis of a deviation between a current command value of each of the phases, and an actual value of current supplied to the electric motor, and such that the weighting unit inputs a command signal of the current ratio of each of the phases into the current compensator, and thereby the current compensator makes the ratios of the respective phase currents different from each other on the basis of the current ratio command signal inputted from the weighting unit.

The polishing apparatus further includes a motor driver configured to drive at least one of the first and second electric motors, and can also be configured such that the motor driver includes a calculator configured to obtain a rotation speed of the electric motor on the basis of a detection value of a rotational position of the electric motor, a speed compensator configured to generate a command signal of current supplied to the electric motor on the basis of a deviation between a command value of rotation speed of the electric motor, the value being inputted via an input interface, and the rotation speed of the electric motor, the speed being obtained by the calculator, and a convertor configured to generate a current command value of at least two of the respective phases on the basis of an electric angle signal generated by using the detection value of the rotational position of the electric motor, and on the basis of the current command signal generated by the speed compensator, such that the weighting unit inputs a current ratio command signal of at least two of the respective phases into the convertor, and such that the convertor makes the current ratios of at least two of the respective phases different from each other on the basis of the current ratio command signal inputted from the weighting unit.

The polishing apparatus further includes an inverter apparatus configured to drive at least one of the first and second electric motors, and can also be configured such that the weighting unit includes an amplifier provided at a subsequent stage of the inverter apparatus, so as to independently amplify each phase current outputted from the inverter apparatus, and so as to supply the amplified current to the electric motor, and also receives a command signal of current amplification values of the respective phases, and such that the amplifier makes the current ratios of the respective phases different from each other by amplifying the respective phase currents on the basis of the command signal of current amplification values of the respective phases.

Further, the present invention has been made in view of the above-described problem. The present invention is to provide a polishing apparatus for flattening the surface of a workpiece, the polishing apparatus being featured by including a polishing table, a first electric motor configured to rotationally drive the polishing table, a substrate holding unit configured to hold the workpiece, a second electric motor configured to rotationally drive the substrate holding unit, at least one of the first and second electric motors having a plurality of phase windings, a current detecting unit configured to detect currents of at least two of the plurality of phases, a combined current generating unit configured to generate a combined current on the basis of at least the two phase currents detected by the current detecting unit, and a torque variation detecting unit configured to detect a change in torque of the electric motor, the change being caused by the polishing, on the basis of a change in the combined current generated by the combined current generating unit.

That is, in the present invention, a current of specific one phase (for example, V-phase) of at least one of the first and second electric motors is not detected, but currents of at least two phases are detected. Further, in the present invention, a combined current is generated on the basis of the detected currents of at least two phases, and a change in the torque of the electric motor is detected on the basis of a change in the generated combined current.

Thereby, variations in each phase current, which is variously changed between electric motors, can be absorbed, and hence variations in the torque detection can be suppressed.

The polishing apparatus may further include an end point detecting unit configured to detect an end point of a polishing process for flattening the surface of the workpiece, on the basis of a change in the torque of the electric motor, the change being detected by the detecting unit.

In the polishing apparatus, at least one of the first and second electric motors may be provided with at least three phase windings of a U-phase, a V-phase, and a W-phase.

In the polishing apparatus, the first electric motor may be provided with at least the three phase windings of the U-phases, the V-phase, and the W-phase.

In the polishing apparatus, the first electric motor may be configured by a synchronous-type AC servo motor or an induction-type AC servo motor.

Further, the polishing apparatus further includes an electric angle signal generating unit configured to generate a rotational angle of at least one of the first and second electric motors on the basis of a detection value of a rotational position of the electric motor, and can also be configured such that the current detecting unit detects at least two phase currents of three phases of the U-phase, the V-phase, and the W-phase of the electric motor, and such that the combined current generating unit generates, as the combined current, a combined three-phase effective current corresponding to the torque of the electric motor on the basis of at least the two phase currents detected by the current detecting unit, and on the basis of the rotational angle of the electric motor, the rotational angle being detected by the electric angle signal generating unit.

Further, the polishing apparatus can also be configured such that the current detecting unit detects at least two phase currents of the currents of three phases of the U-phase, the V-phase, and the W-phase of the electric motor, and such that the combined current generating unit generates, as the combined current, an average current of currents of the three phases on the basis of at least the two phase currents detected by the current detecting unit.

Further, the polishing apparatus further includes a motor driver configured to drive at least one of the first and second electric motors, and can also be configured such that the motor driver includes a calculator configured to obtain a rotation speed of the electric motor on the basis of a detection value of the rotational position of the electric motor, a speed compensator configured to generate a command signal of a current supplied to the electric motor on the basis of a deviation between a command value of the rotation speed of the electric motor, the value being inputted via an input interface, and the rotation speed of the electric motor, the speed being obtained by the calculator, and an electric angle signal generating unit configured to generate a rotational angle of the electric motor on the basis of the detection value of the rotational position of the electric motor, and a convertor configured to generate a current command value of at least two of the respective phases, such that the current detecting unit detects at least two phase currents of the three phase currents of the U-phase, the V-phase, and the W-phase of the electric motor, such that the combined current generating unit generates, as the combined current, a combined three-phase effective current corresponding to the torque of the electric motor on the basis of at least the two phase currents detected by the current detecting unit, and on the basis of the rotational angle of the electric motor, the angle being detected by the electric angle signal generating unit, and such that the convertor generates a current command value of at least two of the respective phases on the basis of a deviation between the current command signal generated by the speed compensator, and the combined effective current generated by the combined current generating unit.

According to the present invention, a change in the current value due to a change in the torque is increased in the phase to which a large weighting value is assigned, and thereby a change in the torque can be more accurately detected, so that the polishing end point can be more accurately determined than before. Further, in association with this, the yield of the workpiece subjected to the flattening process can also be improved.

Further, according to the present invention, variations in each phase current, which is variously changed between electric motors, can be absorbed, and hence variations in the detection of a change in the torque can be suppressed. As a result, variations in the polishing end point detection of a workpiece can be suppressed, and hence variations in the flattening of the workpiece can be suppressed, so that the yield of the workpiece subjected to the flattening process can be improved.

DESCRIPTION OF EMBODIMENTS

In the following, a polishing apparatus according to embodiments of the present invention will be described with reference to the accompanying drawings.

First Embodiment

Figure 1:
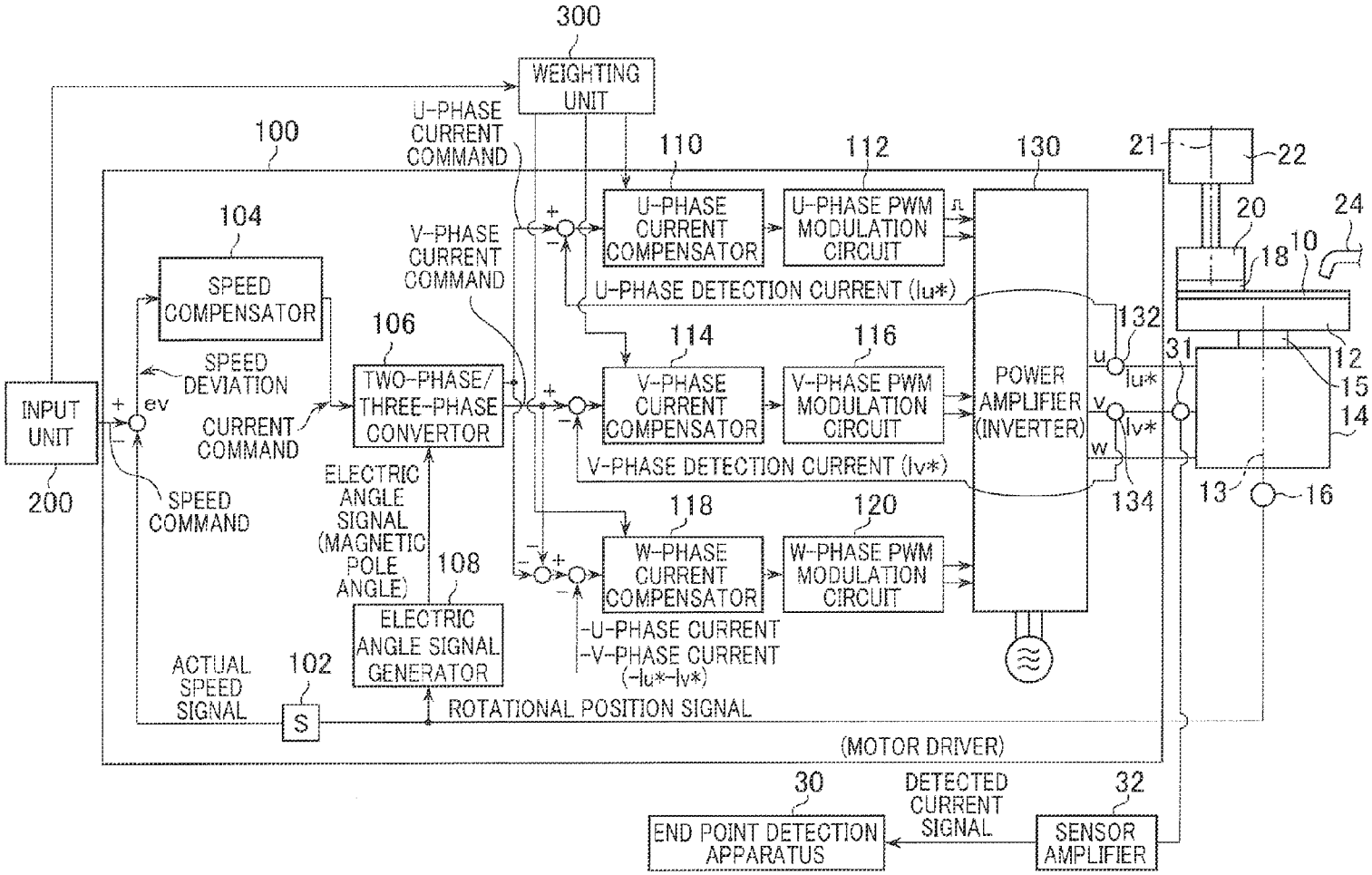
FIG. 1 is a block diagram according to a first embodiment of the present invention.

FIG. 1 is a view showing an entire configuration of a polishing apparatus according to a first embodiment of the present invention.

The polishing apparatus includes a turntable 12 on the upper surface of which a polishing cloth 10 can be attached, a first electric motor 14 which rotationally drives the turntable 12 directly without using a gear, and the like, a position detecting sensor 16 which detects the rotational position of the first electric motor, a top ring (substrate holding unit) 20 which can hold a semiconductor wafer 18, a second electric motor 22 which rotationally drives the top ring 20, and an end point detection apparatus 30 (a torque variation detecting unit, and an end point detecting unit) which detects the polishing end point of the semiconductor wafer 18 by detecting the torque of the turntable 12.

The top ring 20 can be brought close to and separated from the turntable 12 by a holding apparatus (not shown). When the semiconductor wafer 18 is polished, the top ring 20 is brought close to the turntable 12, and thereby the semiconductor wafer 18 held by the top ring 20 is brought into contact with the polishing cloth 10 attached to the turntable 12. The present embodiment is configured such that the polishing end point of the semiconductor wafer 18 is detected by detecting the torque of the first electric motor 14 which directly rotationally drives the turntable 12. However, the present embodiment may also be configured such that the polishing end point of the semiconductor wafer is detected by detecting the torque of the second electric motor which rotationally drives the top ring 20.

When the semiconductor wafer 18, which is an object to be polished, is polished, the semiconductor wafer 18 is pressed onto the polishing cloth 10 by the top ring 20 holding the semiconductor wafer 18, in the state where the turntable 12, to which the polishing cloth 10 is stuck, is rotationally driven by the first electric motor 14. Further, the top ring 20 is rotated about an axial line 21 which is deviated from a rotation axis 13 of the turntable 12. When the semiconductor wafer 18 is polished, an abrasive liquid containing an abrasive material is supplied on the upper surface of the polishing cloth 10 from an abrasive material supply apparatus 24, and the semiconductor wafer 18 set at the top ring 20 is pressed onto the upper surface on which the abrasive material is supplied, of the polishing cloth 10. In other words, when the semiconductor wafer 18 is polished, the surface of the semiconductor wafer 18 is flattened in such a manner that, while the semiconductor wafer 18 is held by the top ring 20, the semiconductor wafer 18 is polished by being pressed onto the turntable 12.

It is preferred that the first electric motor 14 be a synchronous-type or induction-type AC servo motor provided with windings of at least three phases of the U-phase, the V-phase, and the W-phase. In the present embodiment, the first electric motor 14 is configured by an AC servo motor provided with the three phase windings. The three phase windings are configured such that AC currents having phases shifted by 120 degrees from each other are made to respectively flow through field windings provided around a rotor in the electric motor 14 and thereby the rotor is rotationally driven. The rotor of the electric motor 14 is connected to a motor shaft 15, and the turntable 12 is rotationally driven by the motor shaft 15.

Further, the polishing apparatus includes a motor driver 100 which rotationally drives the first electric motor 14, an input unit 200 which receives a command signal of the rotation speed of the first electric motor 14 from an operator via an input interface, such as a keyboard and a touch panel, and which inputs the received command signal into the motor driver 100, and a weighting unit 300 in which the ratios of currents respectively supplied to the three phase windings of the first electric motor 14 are weighted so as to be different from each other.

The motor driver 100 includes a differentiator 102, a speed compensator 104, a two-phase/three-phase convertor 106, an electric angle signal generator 108, a U-phase current compensator 110, a U-phase PWM modulation circuit 112, a V-phase current compensator 114, a V-phase PWM modulation circuit 116, a W-phase current compensator 118, a W-phase PWM modulation circuit 120, a power amplifier 130, and current sensors 132 and 134.

The differentiator 102 generates an actual speed signal corresponding to an actual rotation speed of the first electric motor 14 by differentiating a rotational position signal detected by the position detecting sensor 16. That is, the differentiator 102 is a calculator which obtains a rotation speed of the first electric motor 14 on the basis of a detected value of the rotational position of the first electric motor 14.

The speed compensator 104 compensates the rotation speed of the first electric motor 14 on the basis of a speed deviation signal corresponding to a deviation between a command signal (target value) of the rotation speed inputted via the input unit 200, and the actual speed signal generated by the differentiator 102. That is, the speed compensator 104 generates a command signal of current to be supplied to the first electric motor 14, on the basis of a deviation between the command value of the rotation speed of the first electric motor 14, the value being inputted via the input interface (input unit 200), and the rotation speed of the first electric motor 14, the rotational speed being obtained by the differentiator 102.

The speed compensator 104 can be configured by, for example, a PID controller. In this case, the speed compensator 104 performs proportional control in which the operation amount is changed in proportion to the deviation between the rotation speed command signal inputted from the input unit 200, and the actual speed signal of the first electric motor, and also performs integral control in which the operation amount is changed in proportion to a value obtained by successive addition of the deviation. Further, the speed compensator 104 performs differential control in which a change rate of the deviation (that is, the speed at which the deviation is changed) is obtained and in which the operation amount in proportion to the change rate is outputted. Then, the speed compensator 104 generates a current command signal corresponding to the compensated rotation speed. Note that the speed compensator 104 can also be configured by a PI controller.

The electric angle signal generator 108 generates an electric angle signal on the basis of the rotational position signal detected by the position detecting sensor 16.

The two-phase/three-phase convertor 106 generates a U-phase current command signal and a V-phase current command signal on the basis of the current command signal generated by the speed compensator 104, and on the basis of the electric angle signal generated by the electric angle signal generator 108. That is, the two-phase/three-phase convertor 106 is a convertor which generates current command values of at least two of the respective phases on the basis of the electric angle signal generated by using the detection value of the rotational position of the first electric motor 14, and on the basis of the current command signal generated by the speed compensator 104.

Figure 2:
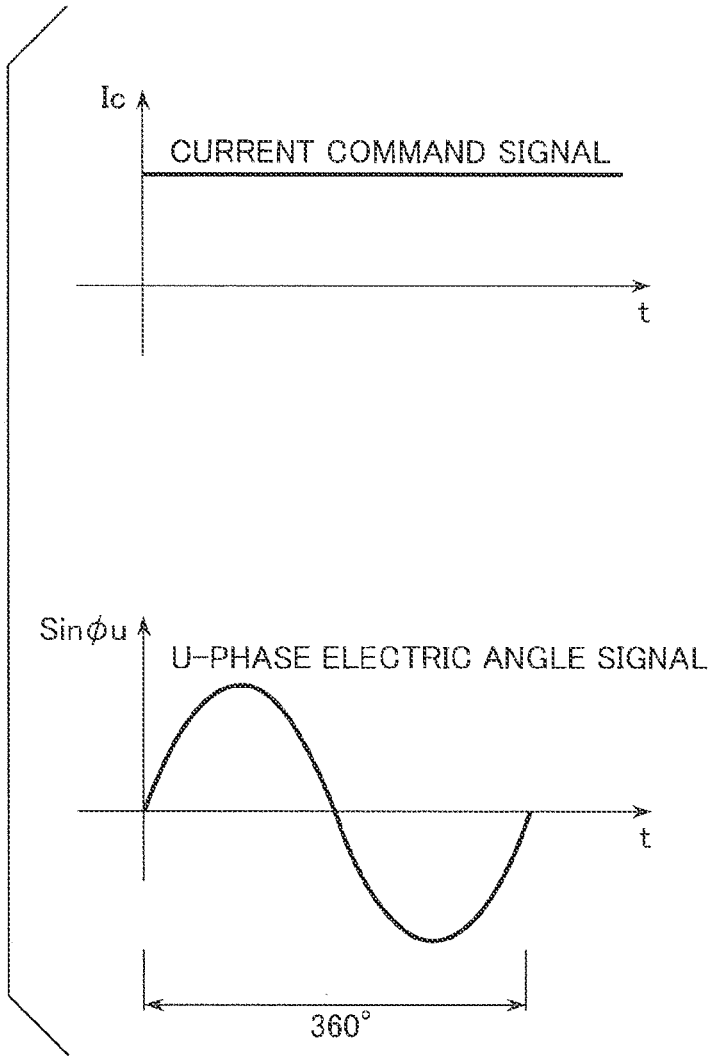
FIG. 2 is a view for explaining processing contents of a two-phase/three-phase convertor.

Here, the processing of the two-phase/three-phase convertor 106 is described in detail. FIG. 2 is a view for explaining processing contents of the two-phase/three-phase convertor. A current command signal Ic as shown in FIG. 2 is inputted from the speed compensator 104 into the two-phase/three-phase convertor 106. Further, an electric angle signal Sin $\phi u$ of the U-phase as shown in FIG. 2 is inputted from the electric angle signal generator 108 into the two-phase/three-phase convertor 106. Note that, although not illustrated in FIG. 2, an electric angle signal Sin $\phi v$ of the V-phase is also inputted into the two-phase/three-phase convertor 106.

For example, a case is considered in which a U-phase current command signal Iuc is generated. In this case, the two-phase/three-phase convertor 106 generates a U-phase current command signal Iuc(i) at a certain time ti by multiplying a current command signal ic(i) by the electric angle signal Sin $\phi u(i)$ of the U-phase. That is, the two-phase/three-phase convertor 106 performs the operation of $Iuc(i)=Ic(i)\times \text{Sin}\ \phi u(i)$. Further, similarly to the case of the U-phase, the two-phase/three-phase convertor 106 generates a V-phase current command signal Ivc(i) at a certain time ti by multiplying a current command signal ic(i) by the electric angle signal Sin $\phi v(i)$ of the V-phase. That is, the two-phase/three-phase convertor 106 performs the operation of $Ivc(i)=Ic(i)\times \text{Sin}\ \phi v(i)$.

The current sensor 132 is provided at a U-phase output line of the power amplifier 130, and detects a U-phase current outputted from the power amplifier 130.

The U-phase current compensator 110 compensates the U-phase current on the basis of a U-phase current deviation signal corresponding to a deviation between the U-phase current command signal Iuc outputted from the two-phase/three-phase convertor 106, and the U-phase detection current Iu* detected and fed back by the current sensor 132. The U-phase current compensator 110 can be configured, for example, by a PI controller or a PID controller. The U-phase current compensator 110 compensates the U-phase current by using PI control or PID control, and generates a U-phase current signal corresponding to the compensated current.

The U-phase PWM modulation circuit 112 performs pulse width modulation on the basis of the U-phase current signal generated by the U-phase current compensator 110. The U-phase PWM modulation circuit 112 generates pulse signals of two systems corresponding to the U-phase current signal by performing pulse width modulation.

The current sensor 134 is provided at a V-phase output line of the power amplifier 130, and detects a V-phase current outputted from the power amplifier 130.

The V-phase current compensator 114 compensates the V-phase current on the basis of a V-phase current deviation signal corresponding to a deviation between the V-phase current command signal Ivc outputted from the two-phase/three-phase convertor 106, and the V-phase detection current Iv* detected and fed back by the current sensor 134. The V-phase current compensator 114 can be configured, for example, by a PI controller or a PID controller. The V-phase current compensator 114 compensates the V-phase current by using PI control or PID control, and generates a V-phase current signal corresponding to the compensated current.

The V-phase PWM modulation circuit 116 performs pulse width modulation on the basis of the V-phase current signal generated by the V-phase current compensator 114. The V-phase PWM modulation circuit 114 generates pulse signals of two systems corresponding to the V-phase current signal by performing pulse width modulation.

The W-phase current compensator 118 compensates the W-phase current on the basis of a W-phase current deviation signal corresponding to a deviation between a W-phase current command signal Iwc generated on the basis of the U-phase current command signal Iuc and the V-phase current command signal Ivc which are outputted from the two-phase/three-phase convertor 106, and each of the U-phase detection current Iu* and the V-phase detection current Iv* which are respectively detected and fed back by the current sensors 132 and 134. The W-phase current compensator 118 can be configured, for example, by a PI controller or a PID controller. The W-phase current compensator 118 compensates the W-phase current by using PI control or PID control, and generates a W-phase current signal corresponding to the compensated current.

The W-phase PWM modulation circuit 120 performs pulse width modulation on the basis of the W-phase current signal generated by the W-phase current compensator 118. The W-phase PWM modulation circuit 118 generates pulse signals of two systems corresponding to the W-phase current signal by performing pulse width modulation.

Figure 10:
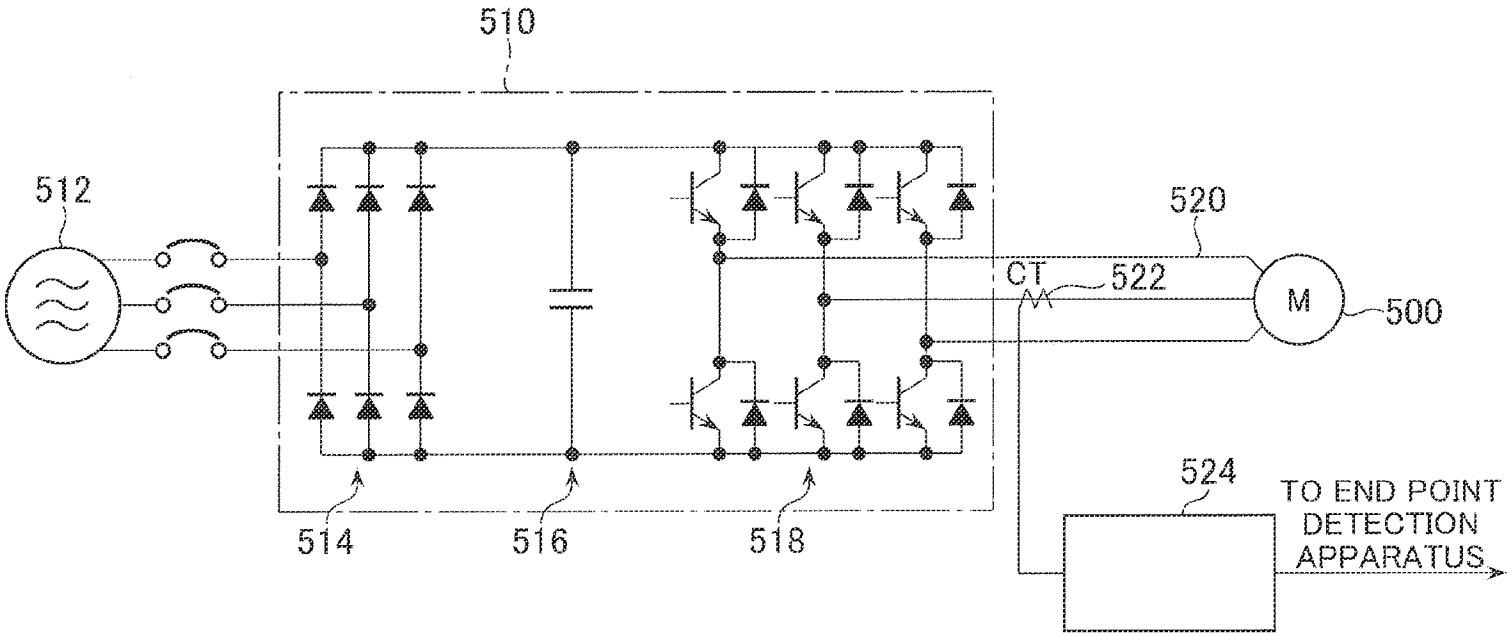
FIG. 10 is a view showing a circuit configuration of a conventional endpoint detecting method based on input power of a drive motor.

The power amplifier 130 is configured by the inverter apparatus 510 described with reference to FIG. 10. The pulse signals of two systems, which are generated by each of the U-phase PWM modulation circuit 112, the V-phase PWM modulation circuit 116, and the W-phase PWM modulation circuit 120, are applied to the inverter unit 518 of the power amplifier 130 (inverter apparatus 510). The power amplifier 130 drives each of the transistors of the inverter unit 518 according to each of the applied pulse signals. Thereby, the power amplifier 130 outputs AC power for each of the U-phase, the V-phase, and the W-phase, so as to rotationally drive the first electric motor 14 by the three-phase AC power.

Next, the weighting unit 300 will be described. The weighting unit 300 receives, from the input unit 200, a weighting command signal for each of the U-phase, the V-phase, and the W-phase of the first electric motor 14. Further, the weighting unit 300 inputs a command signal for weighting the amount of output current (command signal of current ratio of each phase) into each of the U-phase current compensator 110, the V-phase current compensator 114, and the W-phase current compensator 118. For example, the weighting unit 300 gives weighting values of 0.8, 1.2 and 1.0 to the U-phase, the V-phase and the W-phase, respectively.

In this case, the U-phase current compensator 110 outputs a current in an amount 0.8 times the amount of current to be originally outputted from the U-phase current compensator 110, and the V-phase current compensator 114 outputs a current in an amount 1.2 times the amount of current to be originally outputted from the V-phase current compensator 114. The W-phase current compensator 118 outputs the current as-is to be originally outputted from the W-phase current compensator 118. That is, the ratios of currents, which respectively correspond to the phases of the U-phase current compensator 110, the V-phase current compensator 114, and the W-phase current compensator 118, are made different from each other by the current compensators on the basis of the current ratio command signal inputted from the weighting unit 300.

The amount of output current of each of the U-phase, the V-phase, and the W-phase can be weighted by the weighting unit 300 in this way, and hence the amount of current of a specific phase (for example, V phase) can be increased.

Further, in the present embodiment, a second current sensor 31 is provided at the phase (for example, V phase), the amount of current of which is set to be increased by the weighting unit 300. More specifically, the second current sensor 31 is provided at the V-phase current path between the motor driver 100 and the first electric motor 14. The second current sensor 31 detects the current flowing through the V-phase current path, and outputs the detected current to a sensor amplifier 32.

The sensor amplifier 32 amplifies the detected current outputted from the second current sensor 31, and outputs, as a detected current signal, the amplified detected current to the end point detecting unit 30.

The end point detecting unit 30 determines the polishing end point of the semiconductor wafer 18 on the basis of the detected current signal outputted from the sensor amplifier 32. More specifically, the end point detecting unit 30 determines the polishing end point of the semiconductor wafer 18 on the basis of a change in the detected current signal outputted from the sensor amplifier 32.

Figure 3:
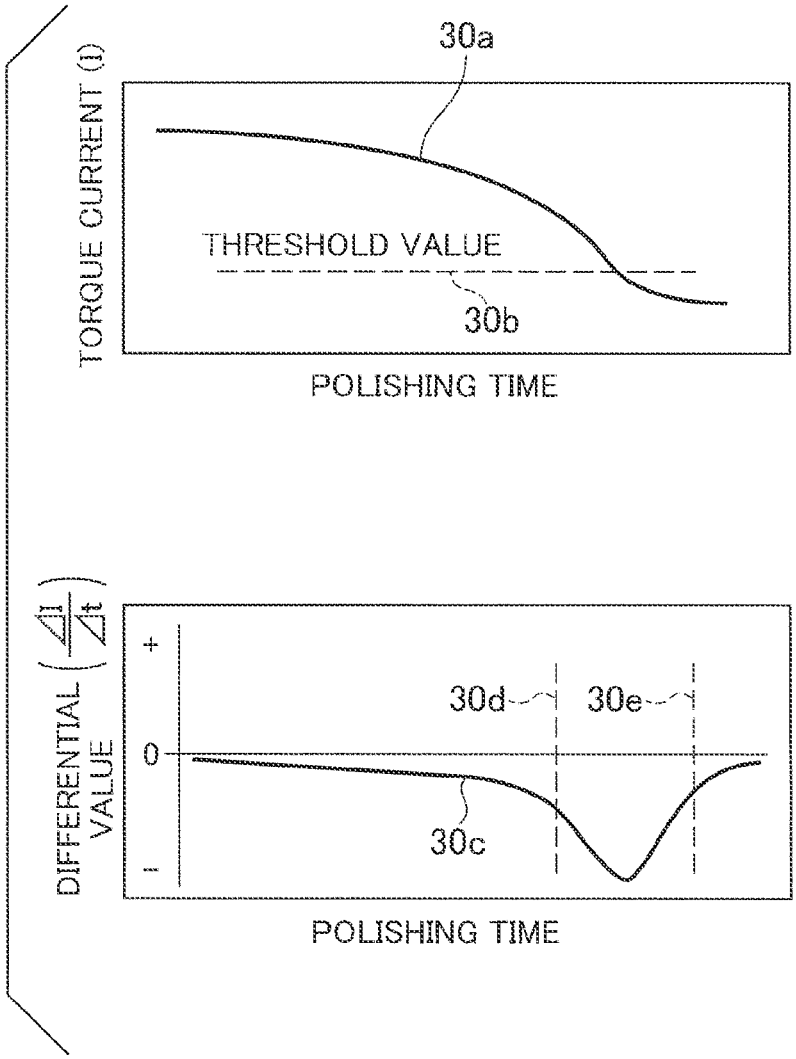
FIG. 3 is a view showing an example of a method for detecting a polishing end point.

The determination of the polishing end point, which is performed by the end point detecting unit 30, will be described with reference to FIG. 3. FIG. 3 is a view showing an example of a method for detecting an end point of polishing. In FIG. 3, the horizontal axis represents the lapse of time, and the vertical axis represents the torque current (I) and the differential value ($\Delta I/\Delta t$) of the torque current. For example, when a torque current 30*a* (the motor current of the V-phase) is changed as shown in FIG. 3, and when the value of the torque current 30*a* becomes smaller than a preset threshold value 30*b*, the end point detecting unit 30 determines that a polishing end point of the semiconductor wafer 18 has been reached. Further, it can also be configured such that the end point detecting unit 30 obtains a differential value 30*c* of the torque current 30*a*, and such that, when the end point detecting unit 30 detects that the inclination of the differential value 30*c* is changed from a negative value to a positive value during the period between preset time threshold values 30*d* and 30*e*, the end point detecting unit 30 determines that the polishing end point of the semiconductor wafer 18 has been reached. That is, the time threshold values 30*d* and 30*e* are set to substantially correspond to a period which is expected, on the basis of an empirical rule, and the like, to include a polishing end point, and the end point detecting unit 30 detects the polishing end point on the basis of the period between the time threshold values 30*d* and 30*e*. For this reason, even when the inclination of the differential value 30*c* is changed from a negative value to a positive value outside the period between the time threshold values 30*d* and 30*e*, the end point detecting unit 30 does not determine that the polishing end point of the semiconductor wafer 18 has been reached. This is to prevent the polishing end point from being erroneously detected in a case where at times, such as a time immediately after the start of polishing, the hunting of the differential value 30*c* is caused by the influence of unstable polishing, so that the inclination of the differential value 30*c* is changed from a negative value to a positive value. In the following, specific examples of the determination of the polishing end point performed by the end point detecting unit 30 will be described.

For example, a case is considered in which the semiconductor wafer 18 is formed by laminating different materials of a semiconductor and a conductor, an insulator, and the like. In this case, the friction coefficients are different between the different material layers, and hence when the polishing process is shifted to a different material layer, the motor torque of the first electric motor 14 is changed. In correspondence with this change, the motor current (detected current signal) of the V-phase is also changed. The end point detecting unit 30 determines the polishing end point of the semiconductor wafer 18 by detecting that the motor current becomes larger or smaller than the threshold value. Further, the end point detecting unit 30 can also determine the polishing end point of the semiconductor wafer 18 on the basis of a change in the differential value of the motor current.

Further, for example, a case is considered in which the polishing surface of the semiconductor wafer 18 is flattened by performing the polishing from the state where depressions and projections exist on the polishing surface. In this case, when the polishing surface of the semiconductor wafer 18 is flattened, the motor torque of the first electric motor 14 is changed. In correspondence with this change, the motor current (detected current signal) of the V-phase is also changed. The end point detecting unit 30 determines the polishing end point of the semiconductor wafer 18 by detecting that the motor current has become smaller than the threshold value. Further, the end point detecting unit 30 can also determines the polishing end point of the semiconductor wafer 18 on the basis of a change in the differential value of the motor current.

Next, operations of the polishing apparatus according to the present embodiment will be described.

An operator performs, via the input unit 200, an operation for driving the first and second electric motors 14 and 22 and operating the polishing apparatus. The required torque of the first electric motor 14 is changed according to the polishing state of the semiconductor wafer 18, but the turntable 12 needs to be rotated at a fixed speed. For this reason, the speed compensator 104 controls, by PID control, and the like, the current flowing through each of the windings of the first electric motor 14. Even when the required torque of the electric motor 14 is changed according to the polishing state of the semiconductor wafer 18, the speed compensator 104 rotationally drives the first electric motor 14 at a fixed speed, and hence the turntable 12 is rotated at a fixed speed. That is, on the basis of a difference between the speed command set in the input unit 200, and an actual speed of the first electric motor 14, the speed being generated by the differentiator 102, the speed compensator 104 calculates, by PID control, and the like, a command value of current to be made to flow through the winding of each phase, and outputs the command value of each phase current.

Here, when the weighting control is not performed similarly to the conventional case, no weighting command is given from the input unit 200 to each of the U-phase current compensator 110, the V-phase current compensator 114, and the W-phase current compensator 118. For this reason, each of the U-phase current compensator 110, the V-phase current compensator 114, and the W-phase current compensator 118 outputs the command value of each phase as-is without weighting the current command value of each phase. As a result, each of the currents, which have substantially the same amplitude and which have phases different by 120° from each other, is supplied to the winding of each phase, and the electric motor 14 generates rotational torque on the basis of the supplied currents.

On the other hand, when weighting is performed for each phase to enable the polishing end detection to be suitably performed, a weighting value is given to each of the U-phase current compensator 110, the V-phase current compensator 114, and the W-phase current compensator 118 from the input unit 200 via the weighting unit 300. For example, when weighting values of 0.8, 1.2 and 1.0 are respectively given to the U-phase current compensator 110, the V-phase current compensator 114, and the W-phase current compensator 118, each of the U-phase current compensator 110, the V-phase current compensator 114, and the W-phase current compensator 118 controls, on the basis of each of the weighting values, each phase current so that the current command value of each phase is assigned to each phase current. That is, the U-phase current compensator 110 outputs a current 0.8 times the current to be originally outputted from the U-phase current compensator 110, and the V-phase current compensator 114 outputs a current 1.2 times the current to be originally outputted from the V-phase current compensator 114. The W-phase current compensator 118 outputs the current as-is to be originally outputted from the W-phase current compensator 118.

When the weighting is performed in this way, the amplitudes of currents flowing through the respective phase windings of the first electric motor 14 are made different from each other. The second current sensor 31 detects the current flowing through the winding through which the largest current flows, that is, the current flowing through the V-phase winding. On the basis of the detected current value, the end point detection apparatus 30 detects the end point of polishing performed by the polishing apparatus.

Figure 4:
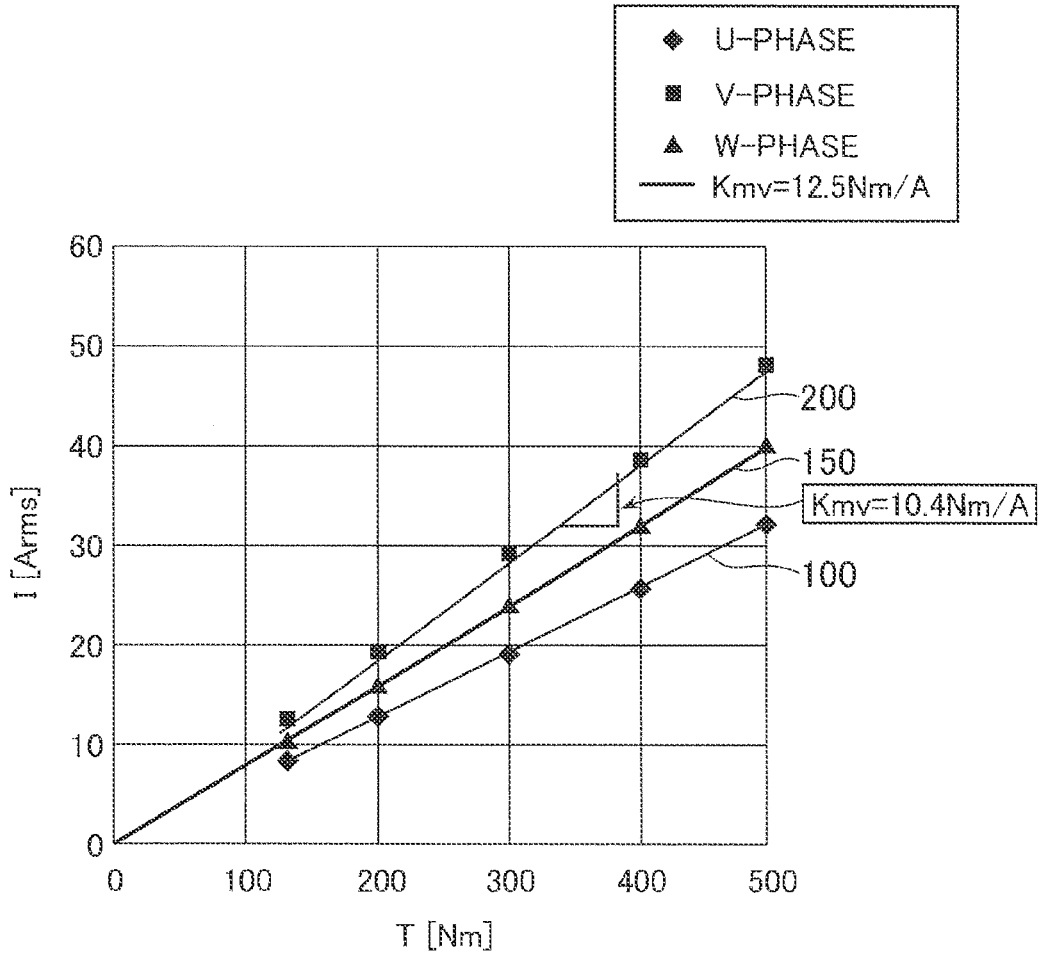
FIG. 4 is a graph showing a relationship between load torque and current which are obtained as experimental values in the first embodiment.

FIG. 4 is a view showing an actually measured example of a relationship between the motor current of each phase winding and the load torque of the electric motor for driving the turntable in the case where the weighting is performed in this way. In FIG. 4, the horizontal axis represents the load torque (Nm), and the vertical axis represents the current (effective current) of the electric motor. In FIG. 4, a diagram 100 is obtained by plotting the U-phase current, a diagram 150 is obtained by plotting the W-phase current, and a diagram 200 is obtained by plotting the V-phase current. When the weighting control is performed to the V-phase in this way, the inclination of the diagram 200 is considerably increased as shown in FIG. 4, and hence a larger change in the current can be detected at the time when the load torque is slightly changed.

When FIG. 4 is seen from a viewpoint of current sensitivity with respect to a change in the rotational load, the current sensitivity is obtained as the reciprocal of 12.5 Nm/A, that is, obtained as $\Delta I \approx 0.08\Delta T$ in the example in which three phase currents are combined, and the current sensitivity is obtained as the reciprocal of 10.4 Nm/A, that is, obtained as $\Delta I \approx 0.1\Delta T$ in the example in which the weighting is performed. In the latter example, the current sensitivity can be improved by about 20%.

As described above, even in the case where the effective current (DC current) is calculated on the basis of a plurality of phase currents of an electric motor, and where the electric motor has the same torque constant (Km=torque/effective current) which is a ratio of load torque to effective current, when the weighting control is applied to the electric motor, the torque constant Km of the V-phase of the electric motor, to which phase the weighting control is applied, can be made small. As a result, when the rotational load is changed, the current of the phase, to which a large weighting value is given, is considerably changed, so that the sensitivity of the end point detection can be improved.

Note that in the present embodiment, an example is shown in which the second current sensor 31 is provided at the V-phase current path between the motor driver 100 and the first electric motor 14, and in which the current value detected by the second current sensor 31 is outputted to the sensor amplifier 32, but the present invention is not limited to this. For example, the second current sensor 31 is not provided, and instead, the value of the V-phase current detected by the current sensor 134 can be outputted from the motor driver 100 to the sensor amplifier 32.

Second Embodiment

Figure 5:
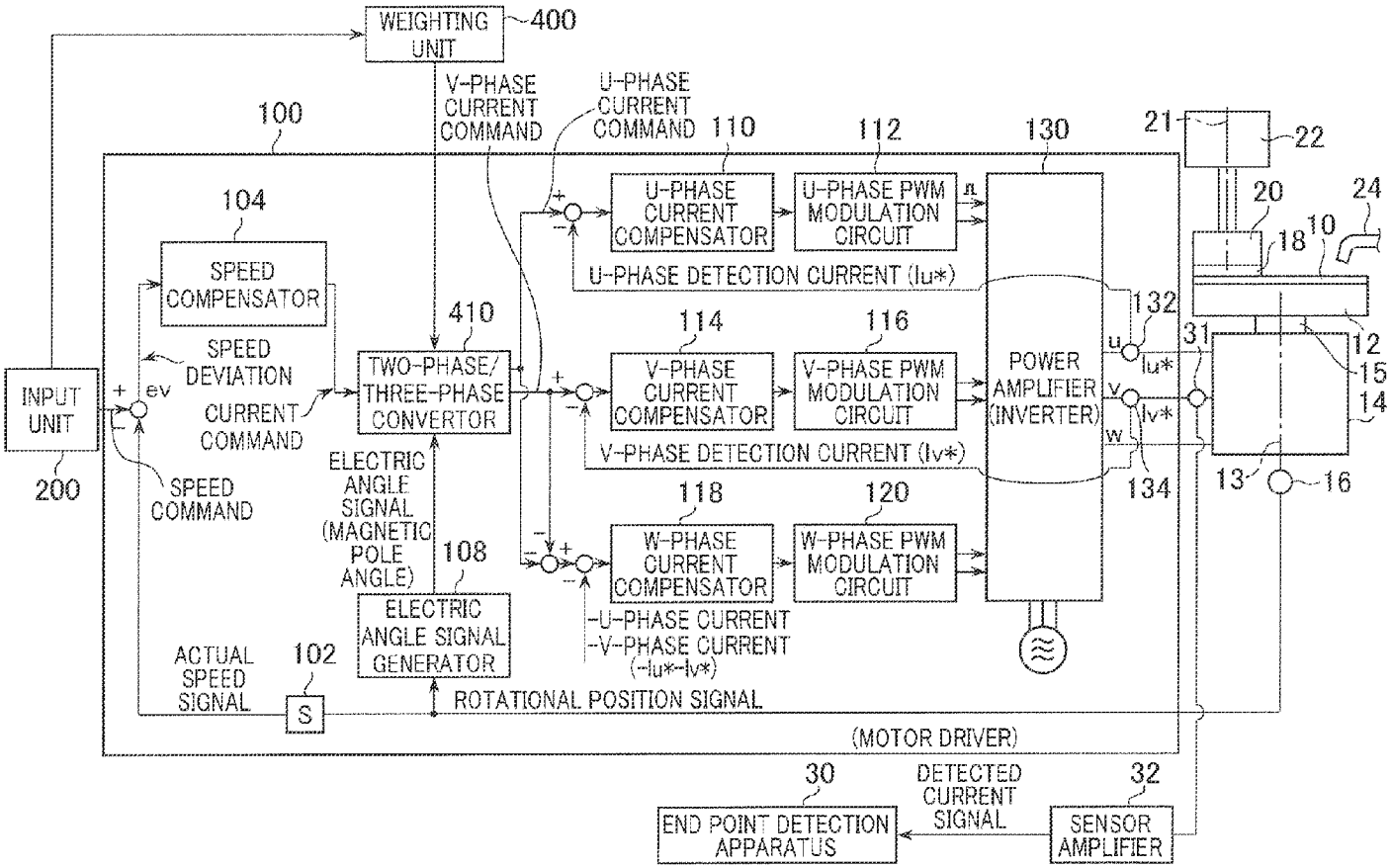
FIG. 5 is a block diagram according to a second embodiment of the present invention.

FIG. 5 is a view showing an entire configuration of a polishing apparatus according to a second embodiment of the present invention. The polishing apparatus of the second embodiment is different from the first embodiment only in the form of the weighting unit and the two-phase/three-phase convertor, and the other configuration is the same as that of the first embodiment. Therefore, in the second embodiment, only the weighting unit and the two-phase/three-phase convertor are described, and the description of the other configuration is omitted.

As shown in FIG. 5, a weighting unit 400 inputs, into a two-phase/three-phase convertor 410, a command signal of the current ratios of at least two phases (the U-phase and the V-phase in the present embodiment) of the phases of the U-phase, the V-phase, and the W-phase. For example, the weighting unit 400 inputs, into the two-phase/three-phase convertor 410, a command signal for respectively assigning weights of 0.8 and 1.2 to the U-phase and the V-phase.

The current ratios of at least the two phases (for example, the U-phase and the V-phase) of the respective phases are made different from each other by the two-phase/three-phase convertor 410 on the basis of the command signal of current ratios inputted from the weighting unit 400.

More specifically, when the U-phase current command signal Iuc is generated, the two-phase/three-phase convertor 410 generates a U-phase current command signal Iuc(i) at a certain time ti by multiplying the current command signal Ic(i) by the electric angle signal Sin $\phi$u(i) of the U-phase and the weight (0.8) of the U-phase. That is, the two-phase/three-phase convertor 410 performs the operation of $Iuc(i)=Ic(i)\times \sin \phi u(i)\times 0.8$.

Further, when the V-phase current command signal Ivc is generated, the two-phase/three-phase convertor 410 generates a V-phase current command signal Ivc(i) at a certain time ti by multiplying the current command signal Ic(i) by the electric angle signal Sin $\phi$v(i) of the V-phase and the weight (1.2) of the V-phase. That is, the two-phase/three-phase convertor 410 performs the operation of $Ivc(i)=Ic(i)\times \sin \phi v(i)\times 1.2$.

As in the second embodiment, even when the command signal for weighting is inputted from the weighting unit 400 to the two-phase/three-phase convertor 410, the amount of current of a specific phase (for example, the V-phase) can be increased more than the other phase, similarly to the first embodiment. Therefore, it is possible to improve the current sensitivity of the V-phase at the time when the rotational load of the first electric motor 14 is changed. As a result, when the rotational load of the first electric motor 14 is changed, the current of the phase, to which a large weight is assigned, is considerably changed, and hence the sensitivity of the end point detection can be improved.

Third Embodiment

Figure 6:
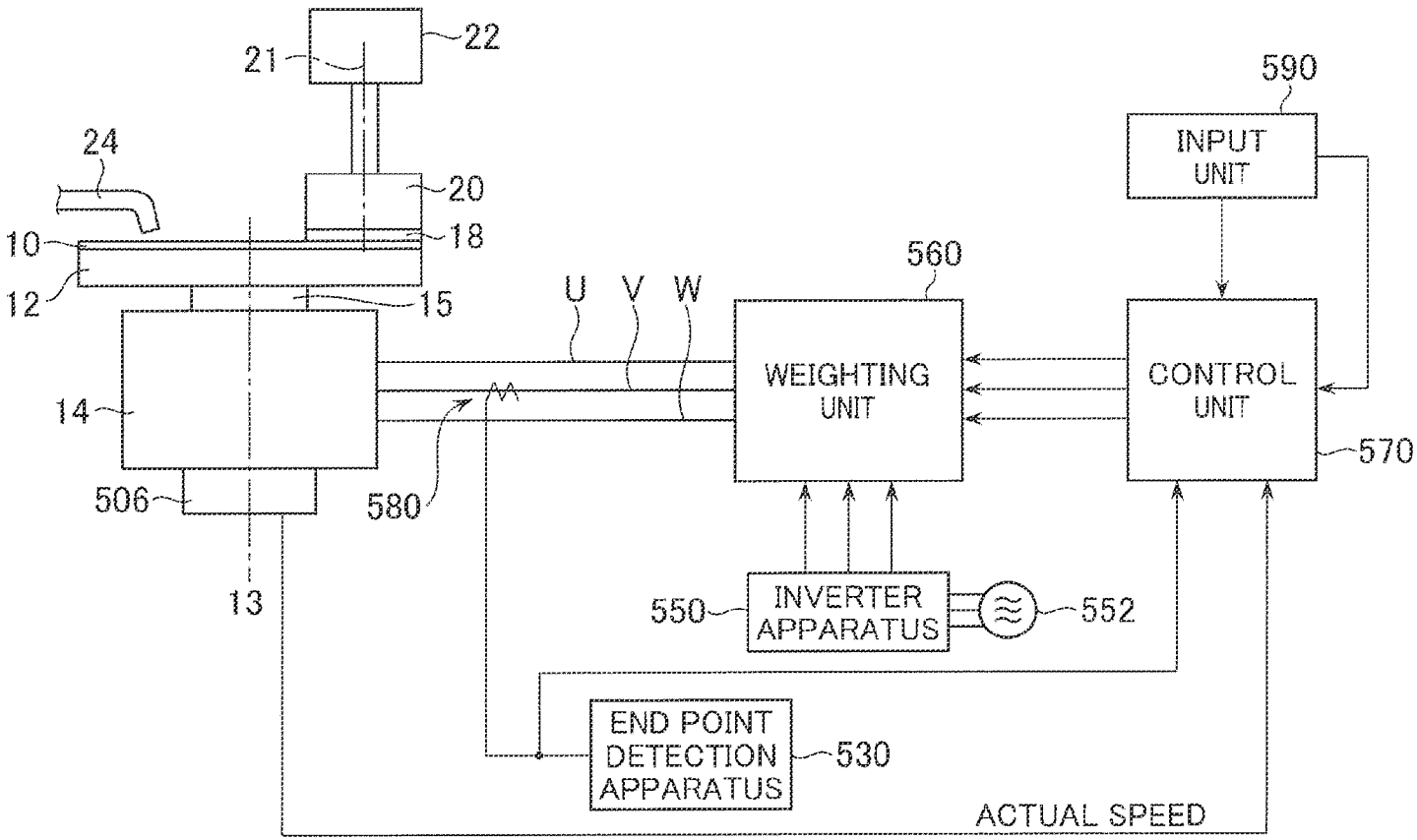
FIG. 6 is a block diagram according to a third embodiment of the present invention.

FIG. 6 is a block diagram according to a third embodiment of the present invention.

In the third embodiment, the configuration of the turntable 12, the first electric motor 14, the top ring 20, and the second electric motor 22, and the like, is the same as those of the first and second embodiments, and hence the descriptions thereof are omitted.

A polishing apparatus of the third embodiment includes a speed sensor 506 which detects the speed of the first electric motor, and an end point detection apparatus 530 which detects the torque of the turntable 12 to detect the polishing end point of the semiconductor wafer 18.

When the electric motor is configured by an AC servo motor provided with three phase windings, it is preferred that the electric motor be driven by an inverter apparatus 550. The inverter apparatus 550 is configured as described with reference to FIG. 10, and is configured such that power from the AC commercial power supply 552 is converted into DC power by the convertor unit, so as to be accumulated in a condenser, such that the DC power is inversely converted into AC power of an arbitrary voltage and an arbitrary frequency by the inverter unit, and such that the converted AC power is supplied to the first electric motor 14.

The first electric motor 14 is provided with the speed sensor 506 for detecting the rotation speed of the rotor of the electric motor. The speed sensor 506 can be configured by a magnetic-type encoder, an optical encoder, a resolver, or the like. When a resolver is adopted, it is preferred that the rotor of the resolver be directly connected to the rotor of the electric motor. When the rotor of the resolver is rotated, a sine signal and a cosine signal are respectively induced in the secondary coils arranged by being shifted by 90° from each other. On the basis of the two signals, the rotor position of the electric motor is detected, so that the speed of the electric motor can be obtained by using a differentiator.

The polishing apparatus includes a weighting unit 560 in which the ratios of the currents respectively supplied to the three phase windings of the first electric motor 14 are made different from each other so as to respectively weight the currents, a control unit 570 which controls the weighting unit, and a current sensor (detecting unit) 580 which detects a change in the phase current greatly weighted by the control unit 570 and thereby detects a change in the torque of the electric motor, the change being caused by the above-described polishing operation. The end point detection apparatus 530 determines the polishing end point from a change in the current value obtained from the current sensor 580.

The current sensor 580 includes a current convertor (CT) provided at one phase, for example, the V-phase, of the three-phase cables 22 which supply electric power to the electric motor, and the value of the motor current flowing through the V-phase is detected by the current convertor (CT). The current sensor 580 is connected to the end point detection apparatus 530 of the polishing apparatus. The value of the current flowing through the V-phase, the current being detected by the current sensor 580, is sent to the end point detection apparatus 530, and the end point detection apparatus 530 determines the polishing end point on the basis of a change in the current value. The current sensor 580 is also connected to the control unit 570. An input unit 590 is connected to the control unit 570. On the basis of a difference between the value of current detected by the current sensor 580, and a set value inputted from the input unit 590, the control unit 570 controls the weighting unit 560, so that the current flowing through the V-phase is amplified by a predetermined amount. In this way, the value of the current flowing through the V-phase is made larger than the values of the currents respectively flowing through the other phases of the U-phase and the W-phase, and thereby the sensitivity of the end point detection performed by the end point detection apparatus 530 is improved.

Figure 7:
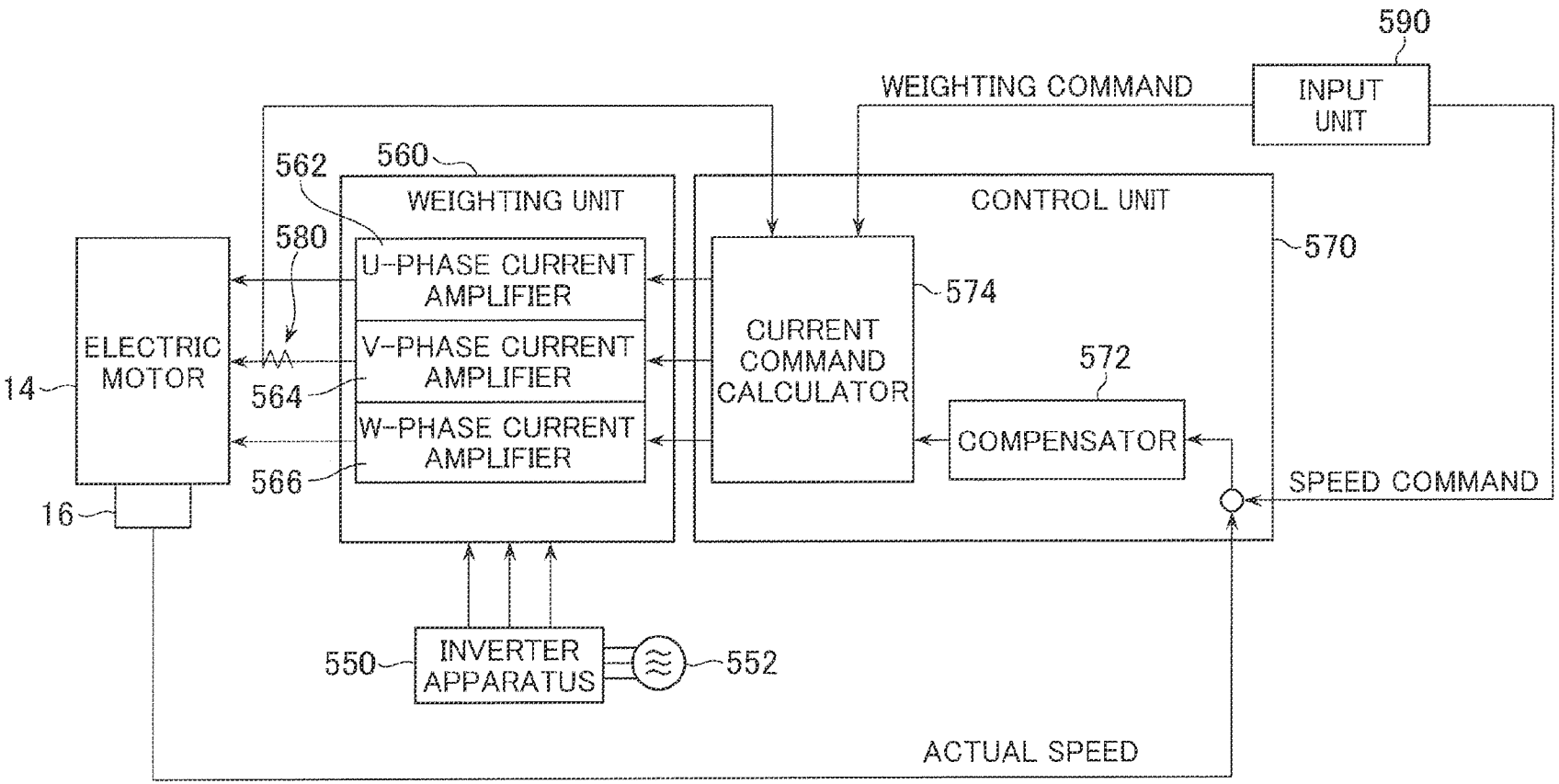
FIG. 7 is a more detailed block diagram of a control unit and a weighting unit which are shown in FIG. 6.

The weighting unit 560 is configured such that the ratios of currents respectively flowing through the three phase windings of the first electric motor 14 are made different from each other, and includes, as shown in FIG. 7, a U-phase current amplifier 562, a V-phase current amplifier 564, and a W-phase current amplifier 566. Each of the U-phase current amplifier 562, the V-phase current amplifier 564, and the W-phase current amplifier 566 is an amplifier which is provided between the inverter apparatus 550 and the first electric motor 14 (provided at a subsequent stage of the inverter apparatus 550), and which independently amplifies the current of each phase of the first electric motor 14 and supplies the amplified current to the first electric motor 14. The weighting unit 560 is connected to the inverter apparatus 550, and the current of each phase, the current being outputted from the inverter apparatus 550, is amplified by a predetermined ratio by the weighting unit 560, so as to be supplied to the electric motor 14. A U-phase cable, a V-phase cable, and a W-phase cable of the inverter apparatus 550 are respectively connected to the U-phase current amplifier 562, the V-phase current amplifier 564, and the W-phase current amplifier 566 of the weighting unit 560, and the amplitudes of currents of the respective phases are made different from each other by the weighting unit 560 on the basis of the command from the control unit 570. For example, when a configuration is adopted in which only the current flowing through the V-phase is amplified and in which the currents flowing through the other phases are not amplified, the weighting unit 560 can be configured only by the V-phase current amplifier 564.

The control unit 570 includes a compensator 572 and a current command calculation unit 574. The input unit 590 is connected to the control unit 570, and a speed value of the first electric motor 14 is supplied to a compensator 572 by a manual input at the input unit 590, so that a weighting value is supplied to the current command calculation unit 574.

The compensator 572, which can be configured by a PID controller, performs proportional control in which the operation amount is changed in proportion to a deviation between the speed of the electric motor as a target value inputted from the input unit 590, and an actually measured value obtained from the speed sensor 16 for detecting the speed of the electric motor. Further, the compensator 572 performs integral control in which the deviations are successively added together and in which the operation amount is changed in proportion to a value obtained by the addition, and also performs differential control in which a rate of change in the deviation (that is, speed of the change of the deviation) is obtained and in which the operation amount is determined in proportion to the speed. The output of the current command value of each phase is controlled by performing the PID control so that the speed of the electric motor 14 becomes the speed as the target value inputted from the input unit 590. Note that the compensator 572 may be configured by a PI controller.

The current command calculation unit 574 is connected to the compensator 572 and the input unit 590, and controls the U-phase current amplifier 562, the V-phase current amplifier 564, and the W-phase current amplifier 566 on the basis of the weighting information of each phase, the information being inputted from the input unit 590, and on the basis of the current command value of each phase, the value being inputted from the compensator 572. As described above, when only the current flowing into the V-phase winding of the electric motor 14 from the V-phase cable of the inverter apparatus 550 is amplified, the current command calculation unit 574 outputs, only to the V-phase current amplifier 564, an amplification command value of a predetermined amplification factor, and outputs an amplification command value of the amplification factor of one to the U-phase current amplifier 562 and the W-phase current amplifier 566. The weighting unit 560 receives the command signal of the amplification value of each phase current from the current command calculation unit 574. Each of the U-phase current amplifier 562, the V-phase current amplifier 564, and the W-phase current amplifier 566 can set the ratio of each phase current to a different value by amplifying each phase current on the basis of the received command signal of the current amplification value of each phase current.

The input unit 590 is configured by a keyboard, a touch panel, or the like. An operator sets a speed value of the electric motor and weighting values via the input unit 590 on the basis of a result obtained by an experiment conducted beforehand, or a result obtained by a simulation.

Next, operations of the polishing apparatus according to the present embodiment will be described.

The operator performs, via the input unit 590, an operation for driving the first and second electric motors 14 and 22 and operating the polishing apparatus. The required torque of the electric motor 14 is changed according to the polishing state of the semiconductor wafer 18, but the turntable 12 needs to be rotated at a fixed speed. For this reason, the compensator 572 of the control unit 570 controls, by PID control, the current flowing through each of the windings of the electric motor 14. Thereby, even when the required torque of the electric motor 14 is changed according to the polishing state of the semiconductor wafer 18, the electric motor 14 is rotationally driven at a fixed speed, and hence the turntable 12 is rotated at a fixed speed. That is, on the basis of a difference between the speed command set in the input unit 590, and an actual speed of the electric motor 14, the speed being detected by the speed sensor 16, the compensator calculates, by PID control, a command value of current to be made to flow through the winding of each phase, and outputs the calculated current command value of each phase.

Here, when the weighting control is not performed similarly to the conventional case, the weighting command is not given from the input unit 590 to the current command calculation unit 574. For this reason, the current command calculation unit 574 outputs, to the current amplifier of each phase, the current command value of each phase, the current command value being outputted from the compensator 572, while maintaining the current command value as-is without weighting the current command value. Therefore, the current amplifier of each phase supplies the currents outputted from the inverter to the electric motor without amplifying the currents. As a result, each of the currents, which have substantially the same amplitude and have phases different by 120° from each other, is supplied to the winding of each phase, and the electric motor 14 generates rotational torque on the basis of the supplied currents.

On the other hand, when the weighting is applied to each phase in order to suitably perform the end point detection, weighting values are given to the current command calculation unit 574 from the input unit 590. For example, when weighting values of 0.8, 1.2 and 1.0 are respectively assigned to the U-phase, the V-phase and the W-phase, the current command calculation unit 574 then controls the current amplifiers 562, 564 and 566 of respective phases so that the current command values of the respective phases, the values being outputted from the compensator 572, are weighted. That is, the current outputted from the inverter apparatus 550 to the U-phase cable of the inverter apparatus 550 is supplied to the U-phase current amplifier 562 in which the amplitude value of the current is multiplied by 0.8 by the U-phase current amplifier, and is then supplied to the U-phase winding of the electric motor 14. On the other hand, the current outputted to the V-phase cable of the inverter apparatus 550 is supplied to the V-phase current amplifier 564 in which the amplitude value of the current is multiplied by 1.2 by the V-phase current amplifier, and is then supplied to the V-phase winding of the electric motor 14. Further, the current outputted to the W-phase cable of the inverter apparatus is supplied to the W-phase current amplifier 566 in which the amplitude value of the current is multiplied by 1.0 by the W-phase current amplifier, that is, the current is not amplified, and is then supplied as-is, to the W-phase winding of the electric motor 14.

When the weighting is performed in this way, the amplitudes of currents flowing through the respective phase windings of the electric motor 14 are made different from each other. The current flowing through the winding through which the largest current flows, that is, the current flowing through the V-phase winding is detected by the current sensor, and the polishing end point detection of the polishing apparatus is performed on the basis of this current value.

As in the third embodiment, even when the current amplifiers 562, 564 and 566 of respective phases are controlled so as to perform the weighting on the basis of the current command values of respective phases, the values being outputted from the compensator 572, the current of a specific phase (for example, the V-phase) can be increased more than the currents of other phases similarly to the first embodiment. Therefore, it is possible to improve the current sensitivity of the V phase at the time when the rotational load of the first electric motor 14 is changed. As a result, when the rotational load of the first electric motor 14 is changed, the current of the phase, to which a large weighting value is assigned, is considerably changed, so that the sensitivity of the end point detection can be improved.

Fourth Embodiment

Figure 8:
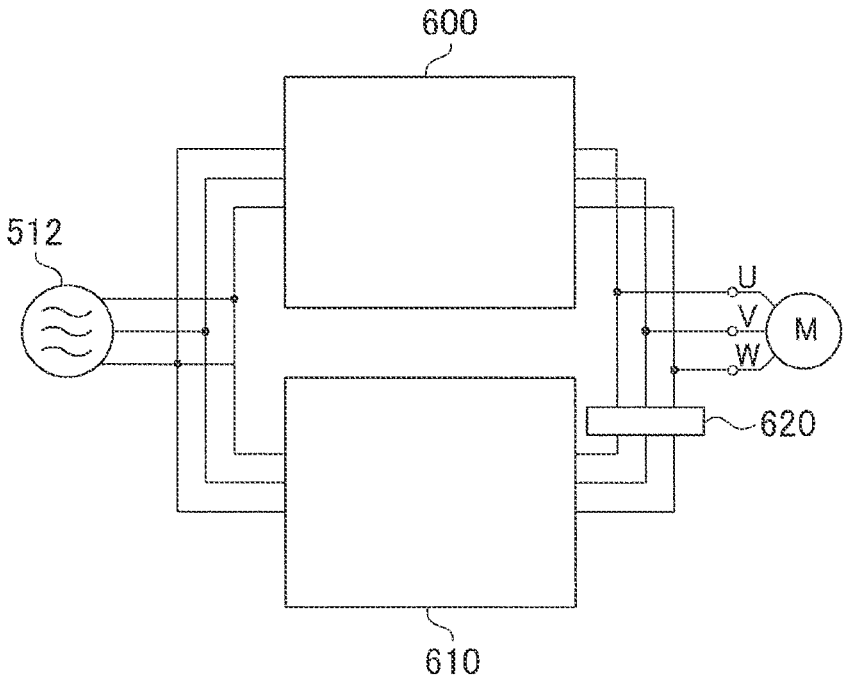
FIG. 8 is a block diagram of a current amplifier according to a fourth embodiment of the present invention.

Note that, in the above-described embodiments, although the current amplifier is configured by a power transistor, and the like, the present invention is not limited to this, and the other configuration may be adopted. FIG. 8 is a block diagram of a current amplifier according to a fourth embodiment of the present invention. As shown in FIG. 8, it can be configured such that a plurality of (for example, two) inverter apparatuses 600 and 610 are connected in parallel with each other, and such that a switching circuit 620 is provided between the two inverter apparatuses. When only the current of the V-phase is weighted, the V-phase output circuits of the two inverters are connected to each other by closing the switching circuit 620, so that the currents flowing from the two inverters can be superimposed on each other so as to flow into the V-phase winding of the electric motor. Note that each of the inverter apparatuses 600 and 610 has the same configuration as that of the inverter apparatus shown in FIG. 7.

Fifth Embodiment

Figure 9:
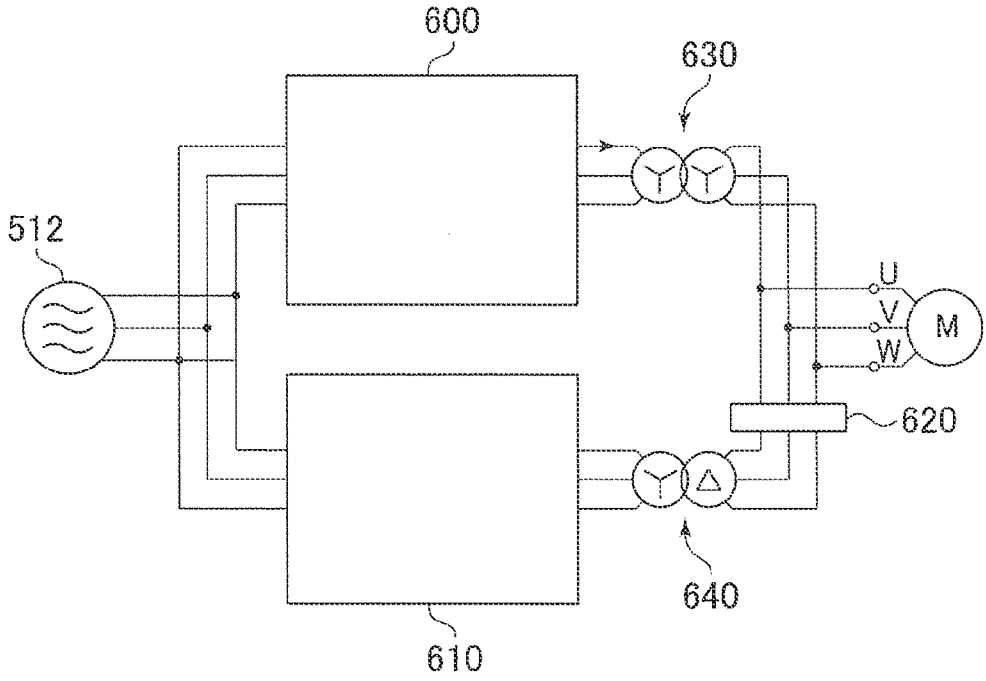
FIG. 9 is a block diagram of a current amplifier according to a fifth embodiment of the present invention.

FIG. 9 is a block diagram of a current amplifier according to a fifth embodiment of the present invention. As shown in FIG. 9, transformers 630 and 640 may be provided on the output side of each of the inverter apparatuses 600 and 610 so that the current values are further amplified.

Further, in the present embodiment, a current sensor for detecting the value of current flowing through the V-phase is provided. With this configuration, the control may be performed in such a manner that the current flowing through the V-phase is amplified, and that the currents flowing through the U-phase and the W-phase are not amplified. However, it may also be configured such that a current sensor for detecting the value of current flowing through each phase is provided, and such that, on the basis of the weighting information of each phase, the information being inputted into the input unit, each phase current amplifier is controlled to amplify the current flowing through each phase.

Although an electric motor provided with three phase windings is used in each of the above-described embodiments, the present invention is not necessarily limited to this, and an electric motor provided with two or more phase windings may also be used.

In the above-described embodiments, the weighting control is applied to the motor current of the electric motor for driving the turntable. However, when the end point detection is performed by using the electric motor for rotationally driving the top ring, the weighting control can also be applied to the motor current of the electric motor for rotationally driving the top ring.

In the following, a polishing apparatus according to an embodiment of the present invention will be described with reference to drawings.

Sixth Embodiment

Figure 11:
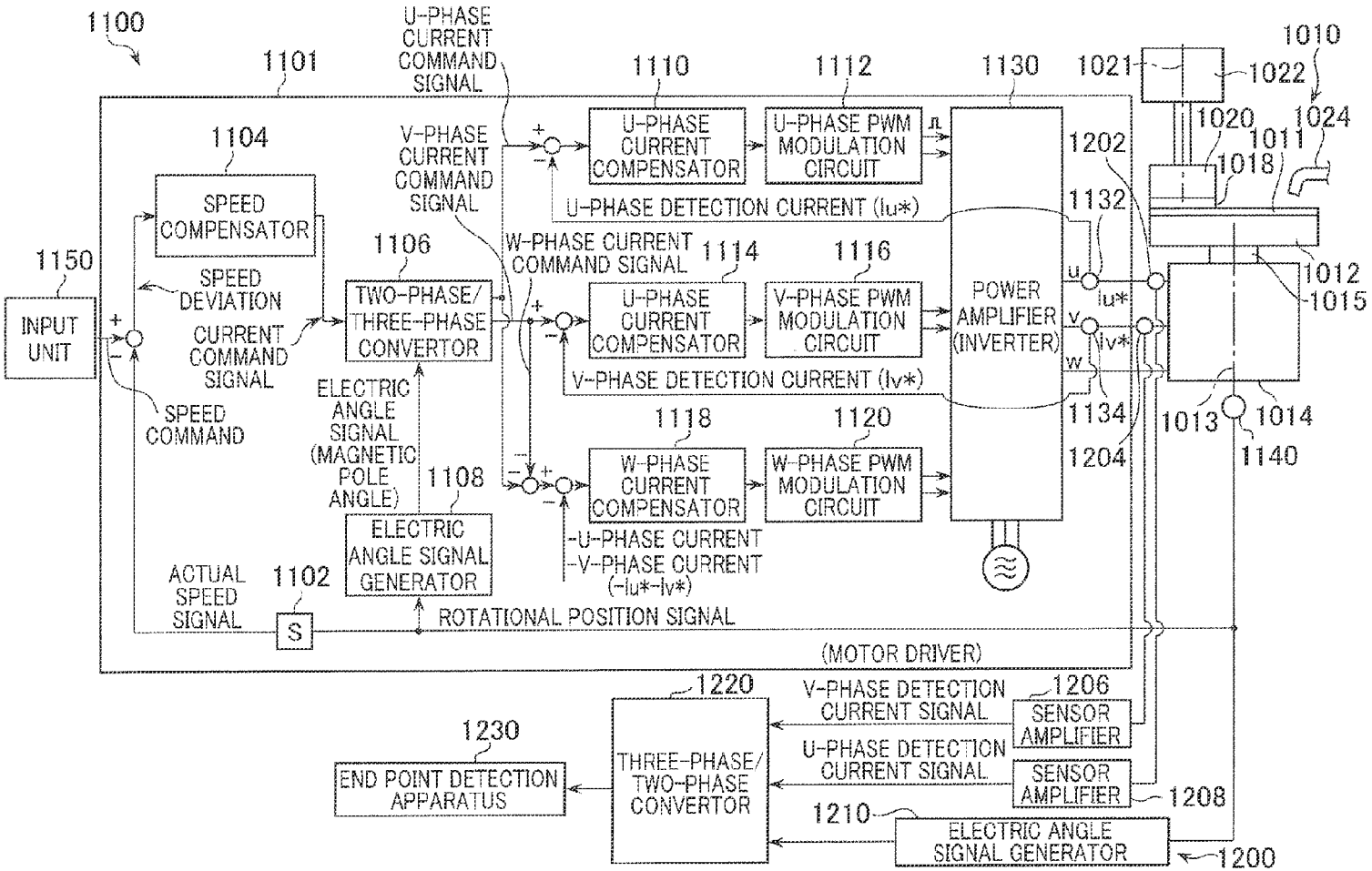
FIG. 11 is a block diagram according to a sixth embodiment of the present invention.

FIG. 11 is a view showing an entire configuration of a polishing apparatus according to a sixth embodiment of the present invention.

First, the polishing apparatus mainly includes a polishing system 1010 which polishes and smooths a workpiece, such as a semiconductor wafer, a drive system 1100 which drives an electric motor included in the polishing system 1010, and a polishing end point system 1200 which detects a polishing end point of the workpiece.

The polishing system 1010 includes a turntable (polishing table) 1012 on the upper surface of which a polishing cloth 1011 can be attached, a first electric motor 1014 which rotationally drives the turntable 1012 directly without using a gear, and the like, a top ring (substrate holding unit) 1020 which can hold a semiconductor wafer 1018 (object to be polished), and a second electric motor 1022 which rotationally drives the top ring 1020. The polishing apparatus is configured such that, while, in the state in which the turntable 1012 is rotated by the first electric motor 1014, and in which the top ring 1020 is rotated by the second electric motor 1022, the semiconductor wafer 1018 is held by the top ring 1020, the semiconductor wafer 1018 is pressed onto the turntable 1012 so that the surface of the semiconductor wafer 1018 is polished and smoothed.

The top ring 1020 can be brought close to and separated from the turntable 1012 by a holding apparatus (not shown). When the semiconductor wafer 1018 is polished, the top ring 1020 is brought close to the turntable 1012, and thereby the semiconductor wafer 1018 held by the top ring 1020 is brought into contact with the polishing cloth 1011 attached to the turntable 1012. The present embodiment is configured such that the polishing end point of the semiconductor wafer 1018 is detected by detecting the torque of the first electric motor 1014 which directly rotationally drives the turntable 1012. However, the present embodiment may also be configured such that the polishing end point of the semiconductor wafer is detected by detecting the torque of the second electric motor which rotationally drives the top ring 1020.

When the semiconductor wafer 1018, which is an object to be polished, is polished, the semiconductor wafer 1018 is pressed onto the polishing cloth 1011 by the top ring 1020 holding the semiconductor wafer 1018, in the state where the turntable 1012, to which the polishing cloth 1010 is stuck, is rotationally driven by the first electric motor 1014. Further, the top ring 1020 is rotated about an axial line 1021 which is deviated from a rotation axis 1013 of the turntable 1012. When the semiconductor wafer 1018 is polished, an abrasive liquid containing an abrasive material is supplied on the upper surface of the polishing cloth 1010 from an abrasive material supply apparatus 1024, and the semiconductor wafer 1018 set at the top ring 1020 is pressed onto the upper surface on which the abrasive material is supplied, of the polishing cloth 1010. In other words, when the semiconductor wafer 1018 is polished, the surface of the semiconductor wafer 1018 is flattened in such a manner that, while the semiconductor wafer 1018 is held by the top ring 1020, the semiconductor wafer 1018 is polished by being pressed onto the turntable 1012.

It is preferred that the first electric motor 1014 be a synchronous-type or induction-type AC servo motor provided with windings of at least three phases of the U-phase, the V-phase, and the W-phase. In the present embodiment, the first electric motor 1014 is configured by an AC servo motor provided with the three phase windings. The three phase windings are configured such that AC currents having phases shifted by 120 degrees from each other are made to respectively flow through field windings provided around a rotor in the electric motor 1014 and thereby the rotor is rotationally driven. The rotor of the electric motor 1014 is connected to a motor shaft 1015, and the turntable 1012 is rotationally driven by the motor shaft 1015.

Next, the drive system 1100 will be described. The drive system 1100 includes a motor driver 1101 which rotationally drives the first electric motor 1014, a position detecting sensor 1140 which detects the rotational position of the first electric motor 1014, an input unit 1150 which receives a command signal of the rotation speed of the first electric motor 1014 from an operator via an input interface, such as a keyboard and a touch panel, and which inputs the received command signal into the motor driver 1101.

The motor driver 1101 includes a differentiator 1102, a speed compensator 1104, a two-phase/three-phase convertor 1106, an electric angle signal generator (electric angle signal generating unit) 1108, a U-phase current compensator 1110, a U-phase PWM modulation circuit 1112, a V-phase current compensator 1114, a V-phase PWM modulation circuit 1116, a W-phase current compensator 1118, a W-phase PWM modulation circuit 1120, a power amplifier 1130, and current sensors 1132 and 1134.

The position detecting sensor 1140 detects the rotational position of the first motor 1014, and outputs the detected rotational position signal to the differentiator 1102, the electric angle signal generator 1108, and an electric angle signal generator 1210 described below.

The differentiator 1102 generates an actual speed signal corresponding to an actual rotation speed of the first electric motor 1014 by differentiating a rotational position signal detected by the position detecting sensor 1140. That is, the differentiator 1102 is a calculator which obtains a rotation speed of the first electric motor 1014 on the basis of a detected value of the rotational position of the first electric motor 1014.

The speed compensator 1104 compensates the rotation speed of the first electric motor 1014 on the basis of a speed deviation signal corresponding to a deviation between a command signal (target value) of the rotation speed inputted via the input unit 1150, and the actual speed signal generated by the differentiator 1102. That is, the speed compensator 1104 generates a command signal of current to be supplied to the first electric motor 1014, on the basis of a deviation between the command value of the rotation speed of the first electric motor 1014, the value being inputted via the input interface (input unit 1150), and the rotation speed of the first electric motor 1014, the rotational speed being obtained by the differentiator 1102.

The speed compensator 1104 can be configured by, for example, a PID controller. In this case, the speed compensator 1104 performs proportional control in which the operation amount is changed in proportion to the deviation between the rotation speed command signal inputted from the input unit 1150, and the actual speed signal of the first electric motor, and also performs integral control in which the operation amount is changed in proportion to a value obtained by successive addition of the deviation. Further, the speed compensator 1104 performs differential control in which a change rate of the deviation (that is, the speed at which the deviation is changed) is obtained and in which the operation amount in proportion to the change rate is outputted. Then, the speed compensator 1104 generates a current command signal corresponding to the compensated rotation speed. Note that the speed compensator 1104 can also be configured by a PI controller.

On the basis of the rotational position signal detected by the position detecting sensor 1140, the electric angle signal generator 1108 generates an electric angle signal corresponding to the rotation speed of the rotor of the first electric motor 1014. The two-phase/three-phase convertor 1106 generates a U-phase current command signal and a V-phase current command signal on the basis of the current command signal generated by the speed compensator 1104, and on the basis of the electric angle signal generated by the electric angle signal generator 1108. That is the two-phase/three-phase convertor 1106 is a convertor which generates current command values of at least two phases of the three phases on the basis of an electric angle signal generated on the basis of the detection value of the rotational position of the first electric motor 1014, and on the basis of the current command signal generated by the speed compensator 1104.

Figure 12:
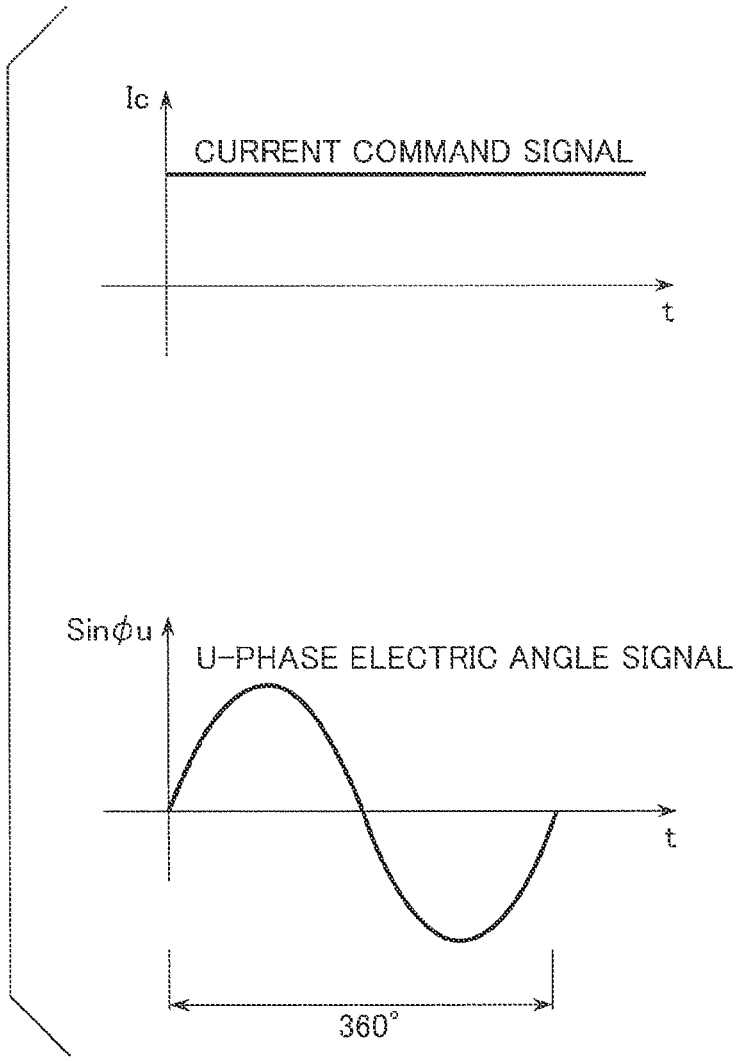
FIG. 12 is a view for explaining processing contents of a two-phase/three-phase convertor.

Here, the processing of the two-phase/three-phase convertor 1106 is described in detail. FIG. 12 is a view for explaining processing contents of the two-phase/three-phase convertor. A current command signal Ic as shown in FIG. 12 is inputted from the speed compensator 1104 into the two-phase/three-phase convertor 1106. Further, an electric angle signal Sin $\phi$u of the U-phase as shown in FIG. 12 is inputted from the electric angle signal generator 1108 into the two-phase/three-phase convertor 1106. Note that, although not illustrated in FIG. 12, an electric angle signal Sin $\phi$v of the V-phase is also inputted into the two-phase/three-phase convertor 1106.

For example, a case is considered in which a U-phase current command signal Iuc is generated. In this case, the two-phase/three-phase convertor 1106 generates a U-phase current command signal Iuc on the basis of an inputted current command signal Ic and an inputted U-phase electric angle signal Sin $\phi$u. For example, the two-phase/three-phase convertor 1106 can operate in such a manner that dq signals in the rotational two-axis coordinate system, which include the U-phase current command signal Iuc, are transformed into $\alpha\beta$ signals in the stationary two-axis coordinate system by performing an inverse dq transformation (inverse Park transformation) using the electric angle signal Sin $\phi$u, and that the $\alpha\beta$ signals are transformed into a U-phase current command signal by performing an inverse $\alpha\beta$ transformation (inverse Clark transformation).

In the case where a V-phase current command signal Ivc is generated, similarly to the case where the U-phase current command signal Iuc is generated, the two-phase/three-phase convertor 1106 generates a V-phase current command signal Ivc on the basis of an inputted current command signal Ic and an inputted V-phase electric angle signal Sin $\phi$v. For example, the two-phase/three-phase convertor 1106 can also operate in such a manner that dq signals in the rotational two-axis coordinate system, which include the V-phase current command signal Ivc, are transformed into $\alpha\beta$ signals in the stationary two-axis coordinate system by performing an inverse dq transformation (inverse Park transformation) using the electric angle signal Sin $\phi$v, and that the $\alpha\beta$ signals are transformed into a V-phase current command signal by performing an inverse $\alpha\beta$ transformation (inverse Clark transformation).

The current sensor 1132 is provided at a U-phase output line of the power amplifier 1130, and detects a U-phase current outputted from the power amplifier 1130. The U-phase current compensator 1110 compensates the U-phase current on the basis of a U-phase current deviation signal corresponding to a deviation between the U-phase current command signal Iuc outputted from the two-phase/three-phase convertor 1106, and the U-phase detection current Iu* detected and fed back by the current sensor 1132. The U-phase current compensator 1110 can be configured, for example, by a PI controller or a PID controller. The U-phase current compensator 1110 compensates the U-phase current by using PI control or PID control, and generates a U-phase current signal corresponding to the compensated current.

The U-phase PWM modulation circuit 1112 performs pulse width modulation on the basis of the U-phase current signal generated by the U-phase current compensator 1110. The U-phase PWM modulation circuit 1112 generates pulse signals of two systems corresponding to the U-phase current signal by performing pulse width modulation.

The current sensor 1134 is provided at a V-phase output line of the power amplifier 1130, and detects a V-phase current outputted from the power amplifier 1130.

The V-phase current compensator 1114 compensates the V-phase current on the basis of a V-phase current deviation signal corresponding to a deviation between the V-phase current command signal Ivc outputted from the two-phase/three-phase convertor 1106, and the V-phase detection current Iv* detected and fed back by the current sensor 1134. The V-phase current compensator 1114 can be configured, for example, by a PI controller or a PID controller. The V-phase current compensator 1114 compensates the V-phase current by using PI control or PID control, and generates a V-phase current signal corresponding to the compensated current.

The V-phase PWM modulation circuit 1116 performs pulse width modulation on the basis of the V-phase current signal generated by the V-phase current compensator 1114. The V-phase PWM modulation circuit 1114 generates pulse signals of two systems corresponding to the V-phase current signal by performing pulse width modulation.

The W-phase current compensator 1118 compensates the W-phase current on the basis of a W-phase current deviation signal corresponding to a deviation between a W-phase current command signal Iwc generated on the basis of the U-phase current command signal Iuc and the V-phase current command signal Ivc which are outputted from the two-phase/three-phase convertor 1106, and each of the U-phase detection current Iu* and the V-phase detection current Iv* which are respectively detected and fed back by the current sensors 1132 and 1134. The W-phase current compensator 1118 can be configured, for example, by a PI controller or a PID controller. The W-phase current compensator 1118 compensates the W-phase current by using PI control or PID control, and generates a W-phase current signal corresponding to the compensated current.

The W-phase PWM modulation circuit 1120 performs pulse width modulation on the basis of the W-phase current signal generated by the W-phase current compensator 1118. The W-phase PWM modulation circuit 1118 generates pulse signals of two systems corresponding to the W-phase current signal by performing pulse width modulation.

The power amplifier 1130 is configured by the inverter apparatus 510 described with reference to FIG. 10. The pulse signals of two systems, which are generated by each of the U-phase PWM modulation circuit 1112, the V-phase PWM modulation circuit 1116, and the W-phase PWM modulation circuit 1120, are applied to the inverter unit 518 of the power amplifier 1130 (inverter apparatus 510). The power amplifier 1130 drives each of the transistors of the inverter unit 518 according to each of the applied pulse signals. Thereby, the power amplifier 1130 outputs AC power for each of the U-phase, the V-phase, and the W-phase, so as to rotationally drive the first electric motor 1014 by the three-phase AC power.

Next, the polishing end point detection system 1200 will be described. The polishing end point detection system 1200 includes a U-phase current detector (current detecting unit) 1202, a V-phase current detector (current detecting unit) 1204, sensor amplifiers 1206 and 1208, the electric angle signal generator (electric angle signal generating unit) 1210, a three-phase/two-phase convertor (combined current generating unit) 1220, and an end point detection apparatus (a torque variation detecting unit, and an end point detecting unit) 1230.

The U-phase current detector 1202 is provided at a U-phase current path between the motor driver 1101 and the first electric motor 1014, and detects a U-phase current outputted from the motor driver 1101.

The V-phase current detector 1204 is provided at a V-phase current path between the motor driver 1101 and the first electric motor 1014, and detects a V-phase current outputted from the motor driver 1101.

The sensor amplifier 1206 amplifies the current detected by the V-phase current detector 1204. Further, the sensor amplifier 1208 amplifies the current detected by the U-phase current detector 1202. The electric angle signal generator 1210 has a function similar to the function of the electric angle signal generator 1108. That is, on the basis of the rotational position signal detected by the position detecting sensor 1140, the electric angle signal generator 1210 generates an electric angle signal as shown in FIG. 12 and corresponding to the rotational angle of the rotor of the first electric motor 1014.

The V-phase and U-phase detection currents respectively amplified by the sensor amplifiers 1206 and 1208, and the electric angle signal generated by the electric angle signal generator 1210 are inputted into the three-phase/two-phase convertor 1220. The three-phase/two-phase convertor 1220 generates a combined current on the basis of the inputted V-phase and U-phase detection currents and the inputted electric angle signal.

For example, the three-phase/two-phase convertor 1220 operates in such a manner that three-axis coordinate system signals of the V-phase detection current, the U-phase detection current, and the W-phase detection current calculated on the basis of the V-phase detection current and the U-phase detection current are transformed into $\alpha\beta$ signals in the stationary two-axis coordinate system by an $\alpha\beta$ transformation (Clark transformation). Subsequently, the three-phase/two-phase convertor 1220 transforms the $\alpha\beta$ signals into dq signals in the rotational two-axis coordinate system by a dq transformation (Park transformation) using the electric angle signal generated by the electric angle signal generator 1210. Further, as a combined current of three-phase currents of the V-phase, the U-phase and the W-phase, the three-phase/two-phase convertor 1220 outputs the q signal of the dq signals, which corresponds to the rotary torque component of the first electric motor 1014.

The end point detection apparatus 1230 determines the polishing end point of the semiconductor wafer 1018 on the basis of the combined current signal outputted from the three-phase/two-phase convertor 1220. More specifically, the end point detection apparatus 1230 detects a change in the torque of the electric motor, the change being caused by the polishing on the basis of a change in the combined current signal outputted from the three-phase/two-phase convertor 1220, thereby determining the polishing end point of the semiconductor wafer 1018 on the basis of the detected torque change.

Figure 13:
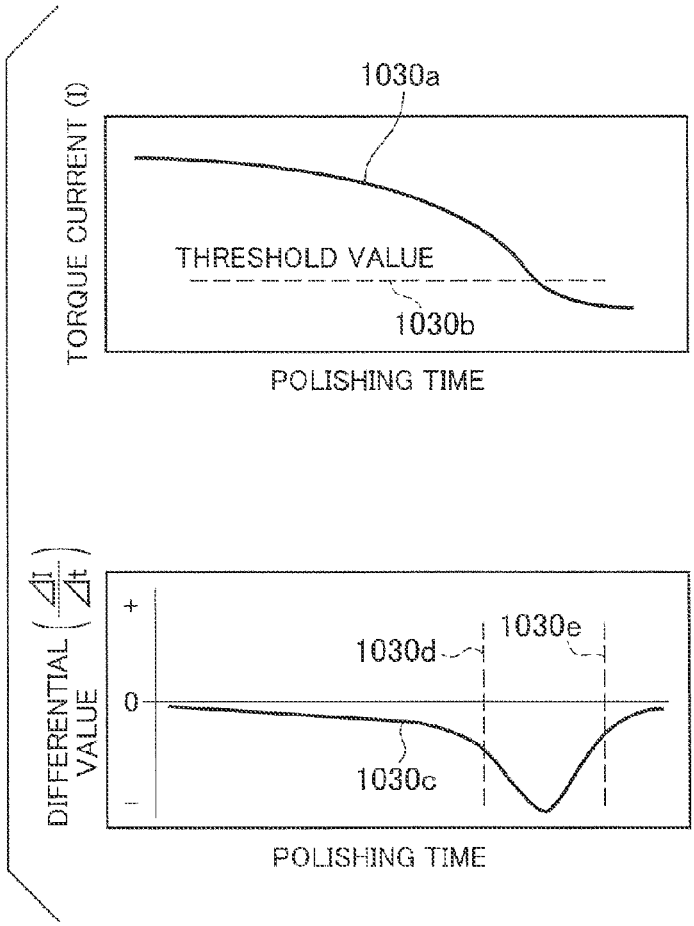
FIG. 13 is a view showing an example of a method for detecting a polishing end point.

The determination of the polishing end point, which is performed by the end point detecting unit 1230, will be described with reference to FIG. 13. FIG. 13 is a view showing an example of a method for detecting an end point of polishing. In FIG. 13, the horizontal axis represents the lapse of time, and the vertical axis represents the torque current (I) and the differential value ($\Delta I/\Delta t$) of the torque current. For example, when a torque current 1030*a* (the motor current of the V-phase) is changed as shown in FIG. 13, and when the value of the torque current 1030*a* becomes smaller than a preset threshold value 1030*b*, the end point detecting unit 1230 determines that a polishing end point of the semiconductor wafer 1018 has been reached. Further, it can also be configured such that the end point detecting unit 1230 obtains a differential value 1030*c* of the torque current 1030*a*, and such that, when the end point detecting unit 1230 detects that the inclination of the differential value 1030*c* is changed from a negative value to a positive value during the period between preset time threshold values 1030*d* and 1030*e*, the end point detecting unit 1230 determines that the polishing end point of the semiconductor wafer 1018 has been reached. That is, the time threshold values 1030*d* and 1030*e* are set to substantially correspond to a period which is expected, on the basis of an empirical rule, and the like, to include a polishing end point, and the end point detecting unit 1230 detects the polishing end point on the basis of the period between the time threshold values 1030*d* and 1030*e*. For this reason, even when the inclination of the differential value 1030*c* is changed from a negative value to a positive value outside the period between the time threshold values 1030*d* and 1030*e*, the end point detecting unit 1230 does not determine that the polishing end point of the semiconductor wafer 1018 has been reached. This is to prevent the polishing end point from being erroneously detected in a case where at times, such as a time immediately after the start of polishing, the hunting of the differential value 1030*c* is caused by the influence of unstable polishing, so that the inclination of the differential value 1030*c* is changed from a negative value to a positive value. In the following, specific examples of the determination of the polishing end point performed by the end point detecting unit 1230 will be described.

For example, a case is considered in which the semiconductor wafer 1018 is formed by laminating different materials of a semiconductor and a conductor, an insulator, and the like. In this case, the friction coefficients are different between the different material layers, and hence when the polishing process is shifted to a different material layer, the motor torque of the first electric motor 1014 is changed. In correspondence with this change, the combined current signal is also changed. The end point detecting apparatus 1230 determines the polishing end point of the semiconductor wafer 1018 by detecting that the combined current signal (motor torque) becomes larger or smaller than a threshold value. Further, the end point detection apparatus 1230 can also determine the polishing end point of the semiconductor wafer 18 on the basis of a change in the differential value of the combined current signal.

Further, for example, a case is considered in which the polishing surface of the semiconductor wafer 1018 is flattened by performing the polishing from the state where depressions and projections exist on the polishing surface. In this case, when the polishing surface of the semiconductor wafer 1018 is flattened, the motor torque of the first electric motor 1014 is changed. In correspondence with this change, the combined current signal is also changed. The end point detecting unit 1230 determines the polishing end point of the semiconductor wafer 1018 by detecting that the combined current signal (motor torque) becomes smaller than a threshold value. Further, the end point detecting unit 1230 can also determine the polishing end point of the semiconductor wafer 1018 on the basis of a change in the differential value of the combined current signal.

Next, operations of the polishing apparatus according to the present embodiment will be described.

An operator performs, via the input unit 1150, an operation for driving the first and second electric motors 1014 and 1022 and operating the polishing apparatus. The required torque of the first electric motor 1014 is changed according to the polishing state of the semiconductor wafer 1018, but the turntable 1012 needs to be rotated at a fixed speed. For this reason, the speed compensator 1104 controls, by PID control, and the like, the current flowing through each of the windings of the first electric motor 1014. Even when the required torque of the electric motor 1014 is changed according to the polishing state of the semiconductor wafer 1018, the speed compensator 1104 rotationally drives the first electric motor 1014 at a fixed speed, and hence the turntable 1012 is rotated at a fixed speed. That is, on the basis of a difference between the speed command set in the input unit 1150, and an actual speed of the first electric motor 1014, the speed being generated by the differentiator 1102, the speed compensator 1104 calculates, by PID control, and the like, a command value of current to be made to flow through the winding of each phase, and outputs the command value of each phase current.

Further, on the basis of a difference between the current command signal of each of the U-phase, the V-phase, and the W-phase, and the actual current of each of the phases, each of the U-phase current compensator 1110, the V-phase current compensator 1114, and the W-phase current compensator 1118 calculates, by PID control, and the like, a signal of current to be made to flow through each of the three phase windings.

The power amplifier 1130 drives each of the transistors of the inverter unit 518 according to each of the phase current signals respectively calculated by the U-phase current compensator 1110, the V-phase current compensator 1114, and the W-phase current compensator 1118, and outputs AC power for each of the U-phase, the V-phase, and the W-phase, so as to rotationally drive the first electric motor 1014.

Here, conventionally, the current of specific one phase (for example, V-phase) of the U-phase, the V-phase, and the W-phase is detected, and the polishing end point of the semiconductor wafer 1018 is determined on the basis of a change in the current of the specific one phase. However, actually, each phase current of the electric motor can be varied. In addition, the currents of the respective phases of the electric motor are not changed in such a manner that the current of a specific phase is always increased or reduced, but there is a possibility that the current of each phase is variously changed due to a variation between the electric motors or due to a variation between the polishing apparatuses. In this situation, when the polishing end detection is performed by measuring the current of specific one phase of the electric motor, the detected current is varied, and hence there is a possibility that the flattening degree of the semiconductor wafer 1018 is varied.

On the other hand, in the present embodiment, currents of at least two phases (the U-phase and the V-phase in the embodiment) of the U-phase, the V-phase, and the W-phase are detected, and the combined current is generated on the basis of the detected currents of at least the two phases. Further, a change in the torque of the electric motor, the change being caused by the polishing, is detected on the basis of a change in the generated combined current. Thereby, it is possible to absorb variation in each phase current which is variously changed between the electric motors.

Figure 14:
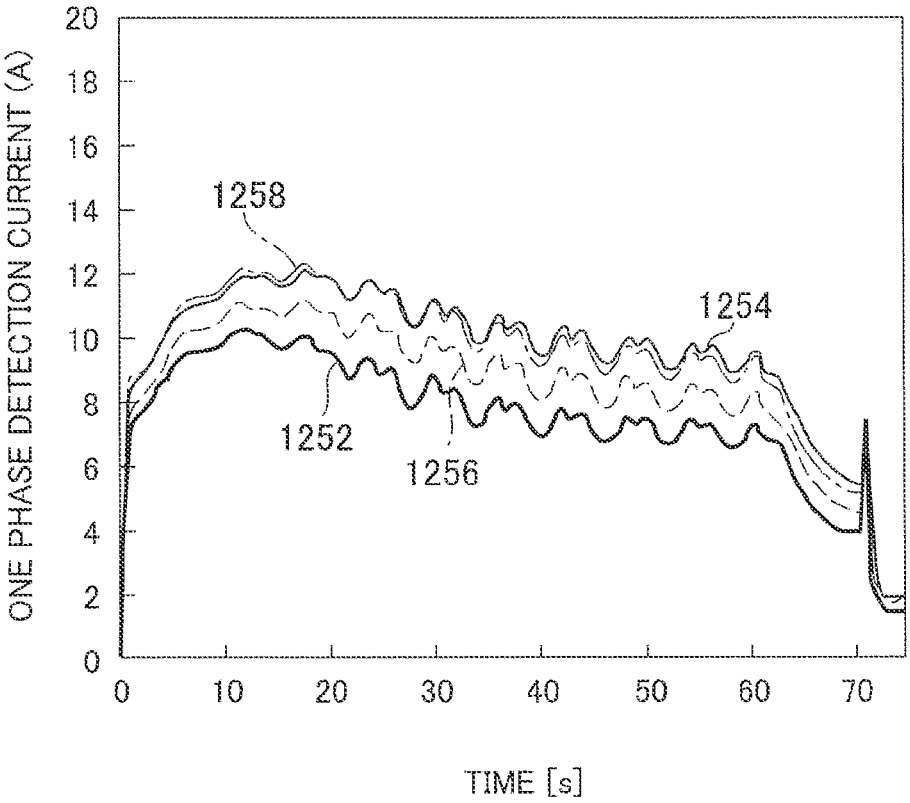
FIG. 14 is a view showing characteristics of currents used for detecting a polishing end point in a comparison example.
Figure 15:
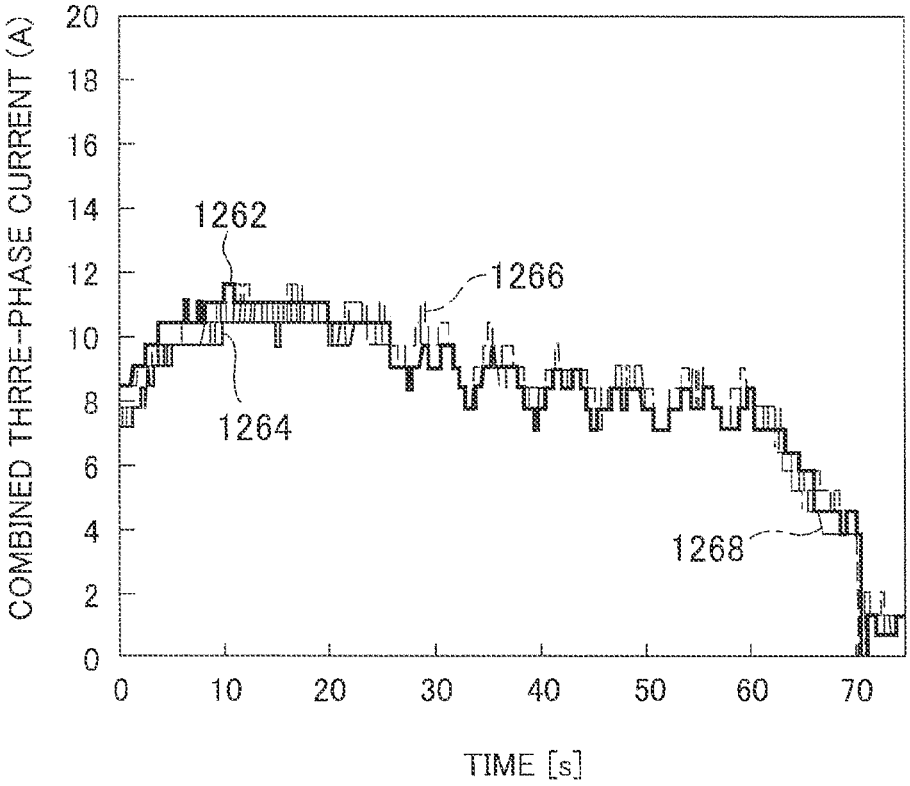
FIG. 15 is a view showing characteristics of currents used for detecting a polishing end point in the sixth embodiment.

This point will be described with reference to FIG. 14 and FIG. 15. FIG. 14 is a graph showing characteristics of currents for polishing end point detection in a comparison example. FIG. 14 shows a transition of the detected currents in the case where, as in the conventional technique, the current of specific one phase (for example, the V-phase) is detected to be used for the polishing end point detection using each of the four samples of A, B, C and D of polishing apparatuses. On the other hand, FIG. 15 is a graph showing characteristics of currents for the polishing end point detection in the sixth embodiment. FIG. 15 shows a transition of the combined current for detection of the polishing end point, the combined current being generated for each of the four samples of A, B, C and D of polishing apparatuses on the basis of the sixth embodiment. In FIG. 14 and FIG. 15, the horizontal axis represents the time axis, and the vertical axis represents the current value for detection of the polishing end point.

First, in FIG. 14 (in which one specific phase current is detected), current transitions 1252, 1254, 1256 and 1258 each correspond to each of the samples A, B, C and D. For example, when the current transition 1252, corresponding to the sample A in which a lower current value is detected, is compared with the current transitions 1254 and 1258 respectively corresponding to the samples B and D in which a higher current value is detected, it is seen that there is a difference of about 2 (A) between the current values of the sample A and the current values of the samples B and D. Further, the current transition 1256 corresponding to the sample C is about in the middle between the current value of the sample A and the current values of the samples B and D. In this way, when specific one phase current is used for polishing end point detection, there arises a variation in the current transitions of the samples A, B, C and D.

On the other hand, as shown in FIG. 15, current transitions 1262, 1264, 1266 and 1268 respectively corresponding to samples A, B, C and D are plotted so as to substantially overlap with each other. When the combined current of three phase currents is generated for use in the polishing end point detection, it is possible to absorb variations in each phase current which is variously changed between the electric motor samples A, B, C and D.

Therefore, variations in the detection of a change in the torque of the electric motor can be suppressed, and hence variations in the detection of the polishing end point of the semiconductor wafer 1018 can be suppressed. As a result, variations in the flattening of the semiconductor wafer 1018 can be suppressed, and thereby the yield of the semiconductor wafer 1018 subjected to the flattening process can also be improved.

Note that, in the present embodiment, an example is shown in which a combined current is generated by using a V-phase detection current, a U-phase detection current, and a W-phase detection current calculated on the basis of the V-phase detection current and the U-phase detection current, and by using an electric angle signal, but the present invention is not limited to this. For example, the present embodiment can also be configured such that currents of specific two phases of the U-phase, the V-phase, and the W-phase are detected, and such that a statistical value, such as an average value, of these detected currents is used as the combined current.

Further, although in the present embodiment, an example is shown in which each of the U-phase current detector 1202 and the V-phase current detector 1204 are provided at each of the U-phase and V-phase current paths between the motor driver 1101 and the first electric motor 1014, and in which the currents detected by these detectors are used as currents for polishing end point detection, the present invention is not limited to this example. For example, a configuration may be adopted such that the U-phase current detector 1202 and the V-phase current detector 1204 are not provided and the U-phase and V-phase current values respectively detected by current sensors 1132 and 1134 incorporated in the motor driver 1101 are made to be outputted from the motor driver 1101 so as to be used as currents for polishing end point detection.

Further, in the present embodiment, an example provided with the electric angle signal generator 1210 is shown, but the present invention is not limited to this. For example, it can also be configured such that the electric angle signal generator 1210 is not provided, and such that an electric angle signal generated by the electric angle signal generator 1108 incorporated in the motor driver 1101 is made to be outputted from the motor driver 1101 so as to be used as an electric angle signal for polishing end point detection.

Seventh Embodiment

Figure 16:
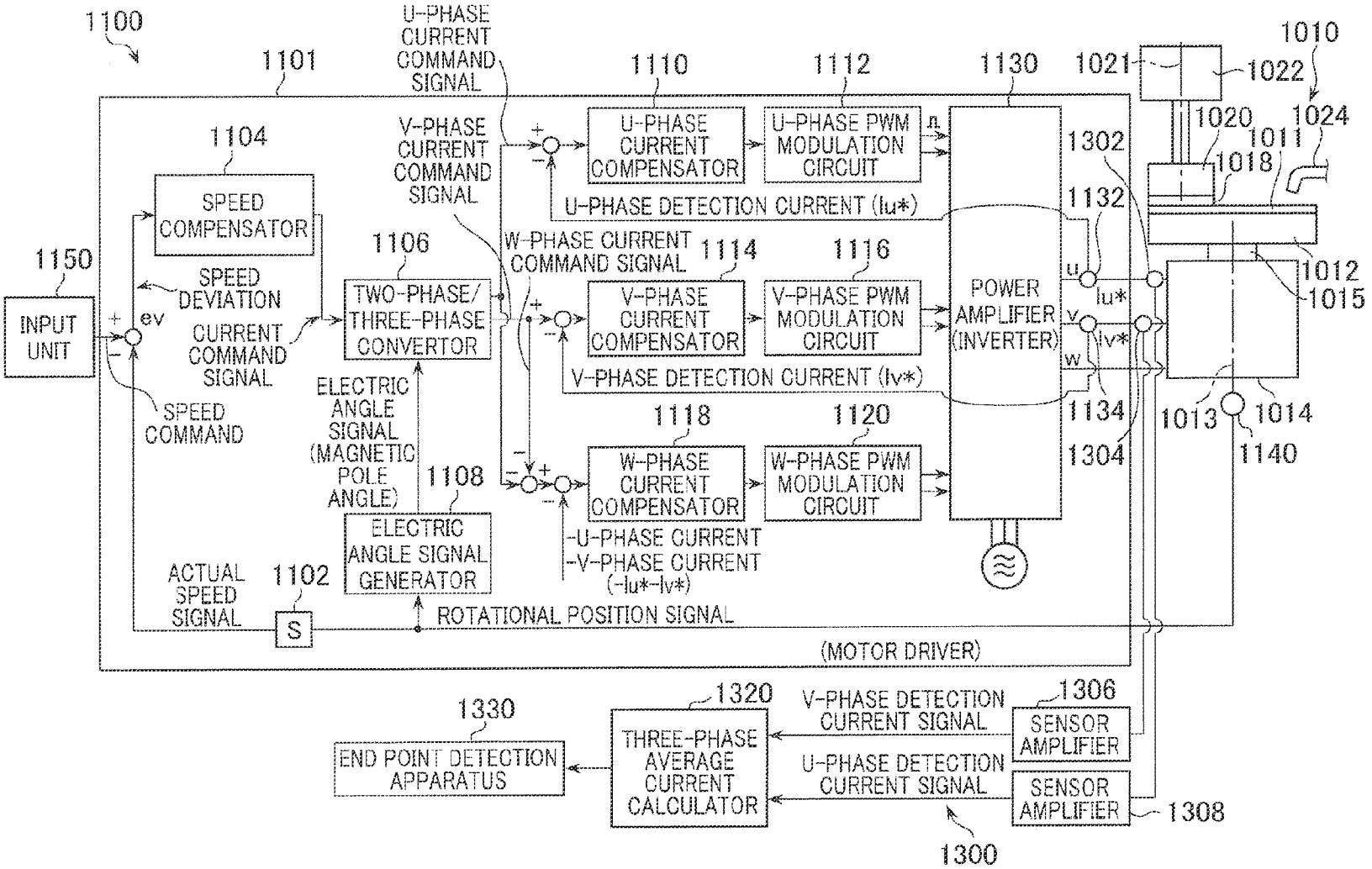
FIG. 16 is a block diagram according to a seventh embodiment of the present invention.

FIG. 16 is a view showing an entire configuration of a polishing apparatus according to a seventh embodiment of the present invention. The polishing apparatus according to the seventh embodiment is different from the polishing apparatus according to the sixth embodiment only in the form of the polishing end point system, and the other configuration of the seventh embodiment is the same as that of the sixth embodiment. Therefore, in the seventh embodiment, only the polishing end point detection system is described, and the description of the other configuration is omitted.

As shown in FIG. 16, a polishing end point detection system 1300 includes a U-phase current detector 1302, a V-phase current detector 1304, sensor amplifiers 1306 and 1308, a three-phase average current calculator (combined current generating unit) 1320, and an end point detection apparatus 1330.

The U-phase current detector 1302 is provided at a U-phase current path between the motor driver 1101 and the first electric motor 1014, and detects a U-phase current outputted from the motor driver 1101.

The V-phase current detector 1304 is provided at a V-phase current path between the motor driver 1101 and the first electric motor 1014, and detects a V-phase current outputted from the motor driver 1101.

The sensor amplifier 1306 amplifies the current detected by the V-phase current detector 1304. Further, the sensor amplifier 1308 amplifies the current detected by the U-phase current detector 1302. The three-phase average current calculator 1320 generates an average current of three phase currents of the U-phase, the V-phase, and the W-phase on the basis of at least two phase currents outputted from the sensor amplifiers 1306 and 1308.

For example, when the V-phase detection current outputted from the sensor amplifier 1306 is set as Iv, and also the U-phase detection current outputted from the sensor amplifier 1308 is set as Iu, and when the W-phase detection current is set as Iw, the three-phase average current calculator 1320 calculates the W-phase detection current on the basis of the expression: $Iw=-Iv-Iu$. Further, the three-phase average current calculator 1320 respectively averages effective values of the V-phase detection current Iv, the U-phase detection current Iu, and the W-phase detection current Iw to thereby generates a combined current of the three phase currents, and outputs, as a combined current signal, the generated current to the end point detection apparatus 1330.

The end point detection apparatus 1330 determines the polishing end point of the semiconductor wafer 1018 on the basis of the combined current signal outputted from the three-phase average current calculator 1320. More specifically, on the basis of a change in the combined current signal outputted from the three-phase average current calculator 1320, the end point detection apparatus 1330 detects a change in the torque a polishing apparatus according to an eighth embodiment of nt of the present invention. The polishing apparatus 1330 determines the polishing end point of the semiconductor wafer 1018 on the basis of the detected change in the torque of the electric motor.

As in the seventh embodiment, even in the case in which at least two phase currents of three phase currents of the U-phase, the V-phase, and the W-phase of the electric motor are detected, and in which an average current of the three phase currents is generated on the basis of at least the detected two phase currents so as to be used for the polishing end point detection, the polishing end point detection is performed on the basis of at least the two phase currents, and hence variations in each phase current, which is variously changed between electric motors, can be absorbed similarly to the sixth embodiment. Therefore, variations in the polishing end point detection of the semiconductor wafer 1018 can be suppressed. As a result, variations in the flattening of the semiconductor wafer 1018 can be suppressed, and hence the yield of the semiconductor wafer 1018 subjected to the flattening process can also be improved.

Eighth Embodiment

Figure 17:
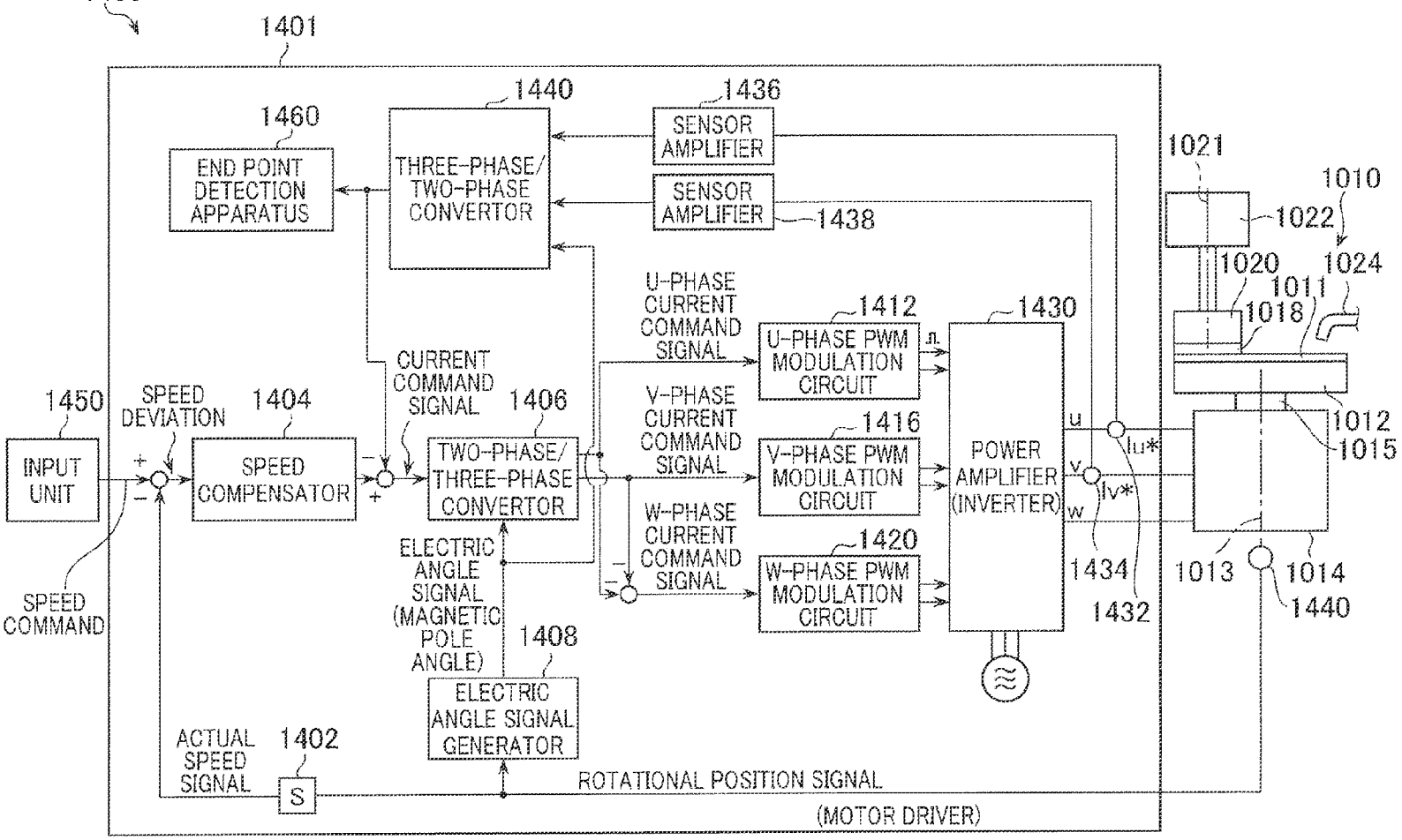
FIG. 17 is a block diagram according to an eighth embodiment of the present invention.

FIG. 17 is a view showing an entire configuration of a polishing apparatus according to an eighth embodiment of the present invention. The polishing apparatus according to the eighth embodiment is different from the polishing apparatus according to the sixth embodiment only in that a polishing end point detection system is incorporated in the motor driver of the drive system, and the other configuration of the eighth embodiment is the same as that of the sixth embodiment. Therefore, in the eighth embodiment, only points different from the sixth embodiment are described, and the description of the other configuration is omitted.

As shown in FIG. 17, a drive system 1400 includes a motor driver 1401 which rotationally drives the first electric motor 1014, the position detecting sensor 1440 which detects the rotational position of the first electric motor 1014, and an input unit 1450 which receives a command signal of the rotation speed of the first electric motor 1014 from an operator via an input interface, such as a keyboard and a touch panel, and which inputs the received command signal into the motor driver 1401.

The motor driver 1401 includes a differentiator 1402, a speed compensator 1404, a two-phase/three-phase convertor 1406, an electric angle signal generator 1408, a U-phase PWM modulation circuit 1412, a V-phase PWM modulation circuit 1416, and a W-phase PWM modulation circuit 1420, a power amplifier 1430 and current sensors 1432 and 1434.

Further, the motor driver 1401 includes sensor amplifiers 1436 and 1438, the three-phase/two-phase convertor 1440, and an end point detection apparatus 1460. The differentiator 1402, the speed compensator 1404, the electric angle signal generator 1408, the power amplifier 1430, and the current sensors 1432 and 1434 are respectively the same as the differentiator 1102, the speed compensator 1104, the electric angle signal generator 1108, the power amplifier 1130, and the current sensors 1132 and 1134 which are described in the sixth embodiment.

The two-phase/three-phase convertor 1406 performs current compensation on the basis of a deviation between a current command signal generated by the speed compensator 1404 and a feedback current signal outputted from the three-phase/two-phase convertor 1440. The two-phase/three-phase convertor 1406 can be configured, for example, by a PI controller or a PID controller.

Further, the two-phase/three-phase convertor 1406 generates a U-phase current command signal and a V-phase current command signal on the basis of the compensated current command signal, and an electric angle signal generated by the electric angle signal generator 1408. For example, when the two-phase/three-phase convertor 1406 generates a U-phase current command signal Iuc, the two-phase/three-phase convertor 1406 can operate in such a manner that dq signals in the rotational two-axis coordinate system, which include the compensated U-phase current command signal, are transformed into αβ signals in the stationary two-axis coordinate system by performing an inverse dq transformation (inverse Park transformation) using an electric angle signal Sin ϕu, and that the αβ signals can be transformed into a U-phase current command signal Iuc by performing an inverse αβ transformation (inverse Clark transformation).

Further, when two-phase/three-phase convertor 1406 generates a V-phase current command signal Ivc, the two-phase/three-phase convertor 1406 can also operate in such a manner that dq signals in the rotational two-axis coordinate system, which include the compensated V-phase current command signal, are transformed into αβ signals by performing an inverse dq transformation (inverse Park transformation) using an electric angle signal Si ϕv, and that the αβ signals are transformed into a V-phase current command signal Ivc by performing an inverse αβ transformation (inverse Clark transformation).

The U-phase PWM modulation circuit 1412 performs pulse width modulation on the basis of the U-phase current command signal generated by the two-phase/three-phase convertor 1406. The U-phase PWM modulation circuit 1412 generates pulse signals of two systems corresponding to the U-phase current command signal by performing the pulse width modulation.

The V-phase PWM modulation circuit 1416 performs pulse width modulation on the basis of the V-phase current command signal generated by the two-phase/three-phase convertor 1406. The V-phase PWM modulation circuit 1416 generates pulse signals of two systems corresponding to the V-phase current command signal by performing the pulse width modulation.

The W-phase PWM modulation circuit 1420 performs pulse width modulation on the basis of a W-phase current command signal generated on the basis of the U-phase current command signal and the V-phase current command signal which are generated by the two-phase/three-phase convertor 1406. The W-phase PWM modulation circuit 1420 generates pulse signals of two systems corresponding to the W-phase current command signal by performing the pulse width modulation.

The sensor amplifier 1436 amplifies the current detected by the current sensor 1432. Further, the sensor amplifier 1438 amplifies the current detected by the current sensor 1434. The V-phase and U-phase detection currents respectively amplified by the sensor amplifiers 1436 and 1438, and an electric angle signal generated by the electric angle signal generator 1408 are inputted into the three-phase/two-phase convertor 1440. The three-phase/two-phase convertor 1440 generates a combined current of the three phase currents of the V-phase, the U-phase, and the W-phase on the basis of the inputted V-phase and U-phase detection currents and the inputted electric angle signal.

For example, the three-phase/two-phase convertor 1440 operates in such a manner that signals in the three-axis coordinate system, which are formed by the V-phase detection current, the U-phase detection current, and the W-phase detection current calculated on the basis of the V-phase detection current and the U-phase detection current, are transformed into αβ signals in the stationary two-axis coordinate system by an αβ transformation (Clark transformation). Subsequently, the three-phase/two-phase convertor 1440 transforms the αβ signals into dq signals in the rotational two-axis coordinate system by a dq transformation (Park transformation) using the electric angle signal generated by the electric angle signal generator 1408.

Further, the three-phase/two-phase convertor 1440 outputs, as feedback current signals, the dq signals, and also outputs, as a combined current of the three phase currents of the V-phase, the U-phase, and the W-phase, the q signal of the dq signals, which corresponds to the rotational torque component of the first electric motor 1014, to the end point detection apparatus 1460.

The end point detection apparatus 1460 determines the polishing end point of the semiconductor wafer 1018 on the basis of the combined current signal outputted from the three-phase/two-phase convertor 1440. More specifically, on the basis of the combined current signal outputted from the three-phase average current calculator 1440, the end point detection apparatus 1460 detects a change in the torque of the electric motor, the change being caused by the polishing. Then, the end point detection apparatus 1460 determines the polishing end point of the semiconductor wafer 1018 on the basis of the detected change in the torque of the electric motor.

As in the eighth embodiment, even in the case in which the polishing end point detection system is incorporated in the motor driver 1401, the polishing end point detection is performed on the basis of at least the two phase currents, and hence variations in each phase current, which is variously changed between electric motors, can be absorbed similarly to the sixth embodiment. Therefore, variations in the polishing end point detection of the semiconductor wafer 1018 can be controlled. As a result, variations in the flattening of the semiconductor wafer 1018 can be suppressed, and hence the yield of the semiconductor wafer 1018 subjected to the flattening process can be improved.

Note that, although an electric motor provided with three phase windings is used in each of the above-described embodiments, the present invention is not necessarily limited to this, and an electric motor may be provided with two or more phase windings.

REFERENCE SIGNS LIST

10 Polishing Cloth
12 Turntable
14 First electric motor
16 Speed sensor
18 Semiconductor wafer
20 Top ring

22 Second electric motor
30 End point detection apparatus
50 Inverter apparatus
100 Motor driver
200 Input unit
300 Weighting unit
1010 Polishing system
1012 Turntable
1014 First electric motor
1018 Semiconductor wafer
1020 Top ring
1022 Second electric motor
1100, 1400 Drive system
1101, 1401 Motor driver
1102, 1402 Differentiator
1104, 1404 Speed compensator
1106, 1406 Two-phase/three-phase convertor
1108, 1408 Electric angle signal generator
1130, 1430 Power amplifier
1132, 1134, 1432, 1434 Current sensor
1150, 1450 Input unit
1200, 1300 Polishing end point detection system
1202 U-phase current detector
1204 V-phase current detector
1210 Electric angle signal generator
1220, 1440 Three-phase/two-phase convertor
1230, 1330, 1460 End point detection apparatus
1320 Three-phase average current calculator

What is claimed is:

1. A polishing apparatus for flattening a surface of a workpiece, the polishing apparatus comprising:

a polishing table;

a first electric motor configured to rotationally drive the polishing table;

a substrate holding unit configured to hold the workpiece;

a second electric motor configured to rotationally drive the substrate holding unit, at least one of the first and second electric motors having a plurality of phase windings;

a weighting unit configured to make currents of the plurality of phase windings different from each other; and a torque variation detecting unit configured to detect a change in a current made by the weighting unit and thereby detect a change in torque of the at least one of the first and second electric motors, the change being generated by performing a polishing of the workpiece.

2. The polishing apparatus according to claim 1, further comprising an end point detecting unit configured to detect an end point of a polishing process for flattening the surface of the workpiece, on the basis of a change in the torque of the at least one of the first and second electric motors, the change being detected by the torque variation detecting unit.

3. The polishing apparatus according to claim 1, wherein at least one of the first and second electric motors is provided with at least three phase windings of a U-phase, a V-phase, and a W-phase.

4. The polishing apparatus according to claim 3, wherein the first electric motor is provided with at least three phase windings of a U-phase, a V-phase, and a W-phase.

5. The polishing apparatus according to claim 4, wherein the first electric motor is configured by a synchronous-type AC servo motor or an induction-type AC servo motor.

6. The polishing apparatus according to claim 1, wherein the weighting unit is configured to make the current of one phase winding greater than currents of other phase windings.

7. The polishing apparatus according to claim 6, wherein the one phase winding is a phase winding of V-phase.

8. The polishing apparatus according to claim 1, wherein the weighting unit is configured by a current amplifier.

9. The polishing apparatus according to claim 1, comprising a first inverter apparatus for controlling the first electric motor.

10. The polishing apparatus according to claim 9, wherein the weighting unit includes a second inverter apparatus configured to connect in parallel with the first inverter apparatus and control the first electric motor, and a switching circuit configured to add a current outputted from the second inverter apparatus to an output current of the first inverter apparatus.

11. The polishing apparatus according to claim 1, further comprising a motor driver configured to drive at least one of the first and second electric motors, wherein the motor driver includes a current compensator configured to compensate currents of the plurality of phase windings on the basis of a deviation between a current command value of each of the phase windings, and an actual value of current supplied to the at least one of the first and second electric motors, the weighting unit inputs a current ratio command signal of each of the phase windings into the current compensator, and the current compensator makes currents of the plurality of phase windings different from each other on the basis of the current ratio command signal inputted from the weighting unit.

12. The polishing apparatus according to claim 1, further comprising a motor driver configured to drive at least one of the first and second electric motors, wherein the motor driver includes a calculator configured to obtain a rotation speed of the at least one of the first and second electric motors on the basis of a detection value of a rotational position of the at least one of the first and second electric motors, a speed compensator configured to generate a command signal of a current supplied to the at least one of the first and second electric motors, on the basis of a deviation between a command value of the rotation speed of the at least one of the first and second electric motors, the command value being inputted via an input interface, and the rotation speed of the at least one of the first and second electric motors, the rotation speed being obtained by the calculator, and a convertor configured to generate current command values of at least two of the plurality of phase windings on the basis of an electric angle signal generated on the basis of the detection value of the rotational position of the at least one of the first and second electric motors, and the current command signal generated by the speed compensator, the weighting unit inputs a current ratio command signal of at least two of the plurality of phase windings into the convertor, and the convertor makes currents of at least two of the plurality of phase windings different from each other on the basis of the current ratio command signal inputted from the weighting unit.

13. The polishing apparatus according to claim 1, further comprising an inverter apparatus configured to drive at least one of the first and second electric motors, wherein the weighting unit includes an amplifier provided in a subsequent stage of the inverter apparatus, so as to independently amplify each current of the plurality of phase windings outputted from the inverter apparatus, and supply the amplified current to the at least one of the first and second electric motors, and also receives a command signal of current amplification values of the plurality of phase windings, and the amplifier makes the currents of the plurality of phase windings different from each other by amplifying the currents of the plurality of phase windings on the basis of the received command signal of current amplification values.

14. A polishing apparatus for flattening a surface of a workpiece, the polishing apparatus comprising:

a polishing table;

a first electric motor configured to rotationally drive the polishing table;

a substrate holding unit configured to hold the workpiece;

a second electric motor configured to rotationally drive the substrate holding unit, at least one of the first and second electric motors having a plurality of phase windings;

a current detecting unit configured to detect currents of at least two of the plurality of phase windings;

a combined current generating unit configured to generate a combined current on the basis of the currents of at least two of the plurality of phase windings detected by the current detecting unit; and a torque variation detecting unit configured to detect a change in torque of the at least one of the first and second electric motors, the change being caused by performing a polishing of the workpiece, on the basis of a change in the combined current generated by the combined current generating unit.

15. The polishing apparatus according to claim 14, further comprising an end point detecting unit configured to detect an end point of a polishing process for flattening the surface of the workpiece, on the basis of a change in the torque of the at least one of the first and second electric motors, the change being detected by the torque variation detecting unit.

16. The polishing apparatus according to claim 14, wherein at least one of the first and second electric motors is provided with at least three phase windings of a U-phase, a V-phase, and a W-phase.

17. The polishing apparatus according to claim 16, wherein the first electric motor is provided with at least three phase windings of a U-phase, a V-phase, and a W-phase.

18. The polishing apparatus according to claim 17, wherein the first electric motor is configured by a synchronous-type AC servo motor or an induction-type AC servo motor.

19. The polishing apparatus according to claim 14, further comprising an electric angle signal generating unit configured to generate a rotational angle of the at least one of the first and second electric motors on the basis of a detection value of a rotational position of at least one of the first and second electric motors, wherein the current detecting unit detects currents of at least two of three phase windings of a U-phase, a V-phase, and a W-phase of the at least one of the first and second electric motors, and the combined current generating unit generates, as the combined current, a combined three-phase effective current corresponding to the torque of the at least one of the first and second electric motors on the basis of the currents of at least two of the three phase windings, the currents being detected by the current detecting unit, and on the basis of a rotational angle of the at least one of the first and second electric motors, the rotational angle being detected by the electric angle signal generating unit.

20. The polishing apparatus according to claim 14, wherein the current detecting unit detects currents of at least two of three phase windings of a U-phase, a V-phase, and a W-phase of the at least one of the first and second electric motors, and the combined current generating unit generates, as the combined current, an average current of currents of the three phase windings on the basis of the currents of at least two of the three phase windings which are detected by the current detecting unit.

21. The polishing apparatus according to claim 14, further comprising a motor driver configured to drive at least one of the first and second electric motors, wherein: the motor driver includes a calculator configured to obtain a rotation speed of the at least one of the first and second electric motors on the basis of a detection value of a rotational position of the at least one of the first and second electric motors, a speed compensator configured to generate a command signal of current supplied to the at least one of the first and second electric motors on the basis of a deviation between a command value of the rotation speed of the at least one of the first and second electric motors, the command value being inputted via an input interface, and the rotation speed of the at least one of the first and second electric motors, the rotation speed being obtained by the calculator, an electric angle signal generating unit configured to generate a rotational angle of the at least one of the first and second electric motors on the basis of a detection value of the rotational position of the at least one of the first and second electric motors, and a convertor configured to generate a current command value of at least two of the plurality of phase windings;

the current detecting unit detects currents of at least two of three phase windings of the U-phase, the V-phase, and the W-phase of the at least one of the first and second electric motors;

the combined current generating unit generates, as the combined current, a combined three-phase effective current corresponding to torque of the at least one of the first and second electric motors, on the basis of the currents of at least two of the three phase windings detected by the current detecting unit, and on the basis of the rotational angle of the at least one of the first and second electric motors, the rotational angle being detected by the electric angle signal generating unit; and the convertor generates a current command value of at least two of the plurality of phase windings on the basis of a deviation between the current command signal generated by the speed compensator, and the combined effective current generated by the combined current generating unit.

* * * * *